US012339070B2

(12) United States Patent
Nakamura et al.

(10) Patent No.: US 12,339,070 B2
(45) Date of Patent: Jun. 24, 2025

(54) HEAT EXCHANGER

(71) Applicant: Mitsubishi Electric Corporation, Tokyo (JP)

(72) Inventors: Masashi Nakamura, Tokyo (JP); Ryohei Kawabata, Tokyo (JP); Naoki Chiku, Tokyo (JP); Masaki Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 121 days.

(21) Appl. No.: 18/263,016

(22) PCT Filed: Mar. 31, 2021

(86) PCT No.: PCT/JP2021/013858
§ 371 (c)(1),
(2) Date: Jul. 26, 2023

(87) PCT Pub. No.: WO2022/208733
PCT Pub. Date: Oct. 6, 2022

(65) Prior Publication Data

US 2024/0085116 A1 Mar. 14, 2024

(51) Int. Cl.
*F28D 7/16* (2006.01)

(52) U.S. Cl.
CPC ..... *F28D 7/16* (2013.01)

(58) Field of Classification Search
CPC ..... F28D 7/16; F28F 9/001; F28F 9/02; F28F 9/0202
See application file for complete search history.

(56) References Cited

U.S. PATENT DOCUMENTS 3,625,170 A * 12/1971 Josok ..... B21D 22/04 72/334
5,125,454 A * 6/1992 Creamer ..... F28F 9/0243 165/149

(Continued)

FOREIGN PATENT DOCUMENTS

JP H05-052578 U 7/1993
JP H06-040684 U 5/1994

(Continued)

OTHER PUBLICATIONS

International Search Report of the International Searching Authority mailed Jun. 8, 2021 for the corresponding International Application No. PCT/JP2021/013858 (and English translation).

*Primary Examiner* — Raheena R Malik
(74) *Attorney, Agent, or Firm* — Posz Law Group, PLC

(57) ABSTRACT

A heat exchanger is provided with a header that has a body section formed in a cylindrical shape and a divider that divides an internal space in the body section. In a state in which the body section and the divider are combined with each other, plate distal end portions of a pair of side plate portions of the divider do not protrude from a pair of respective insertion portions of the body section toward an outside of the body section. The plate distal end portions are deformed in such a state that walls of the plate distal end portions are spread out such that end faces of the plate distal end portions each form a V-shaped groove, and are in engagement with inner walls of the pair of respective insertion portions inside through holes defined by the pair of respective insertion portions.

10 Claims, 12 Drawing Sheets

(56) References Cited

U.S. PATENT DOCUMENTS

| | | | | | |
|---|---|---|---|---|---|
| 5,209,292 | A * | 5/1993 | Arneson | F28F 9/0224 | 29/890.052 |
| 5,236,044 | A | 8/1993 | Nagasaka et al. | | |
| 5,297,624 | A | 3/1994 | Haussmann et al. | | |
| 5,607,012 | A * | 3/1997 | Buchanan | F28F 9/0224 | 165/173 |
| 5,842,515 | A * | 12/1998 | Kim | F28F 9/182 | 165/173 |
| 6,234,238 | B1 * | 5/2001 | Koyama | F28F 9/0224 | 165/174 |
| 7,418,999 | B2 * | 9/2008 | Takano | F28F 9/0204 | 165/110 |
| 8,915,294 | B2 * | 12/2014 | Mazzocco | F28F 9/001 | 165/149 |
| 2003/0010484 | A1 | 1/2003 | Chikuma et al. | | |
| 2005/0211420 | A1 | 9/2005 | Takano | | |
| 2007/0131385 | A1 * | 6/2007 | Misiak | F28F 9/182 | 165/173 |
| 2007/0204982 | A1 * | 9/2007 | Barnes | F28F 9/18 | 165/173 |
| 2015/0059401 | A1 | 3/2015 | Matsuda et al. | | |
| 2024/0085116 | A1 * | 3/2024 | Nakamura | F28F 9/0207 | |

FOREIGN PATENT DOCUMENTS

| | | | |
|---|---|---|---|
| JP | 2000-304488 | A | 11/2000 |
| JP | 2002-267388 | A | 9/2002 |
| JP | 2003-004394 | A | 1/2003 |
| JP | 2015-200497 | A | 11/2015 |
| WO | 2003/102486 | A1 | 12/2003 |

* cited by examiner

HEAT EXCHANGER

CROSS REFERENCE TO RELATED APPLICATION

This application is a U.S. national stage application of PCT/JP2021/013858 filed on Mar. 31, 2021, the contents of which are incorporated herein by reference.

TECHNICAL FIELD

The present disclosure relates to a heat exchanger having a plurality of flat tubes.

BACKGROUND ART

A parallel-flow heat exchanger has been known as a heat exchanger for use in an automobile, for use in air conditioning, or for other uses. A parallel-flow heat exchanger has, for example, a pair of headers placed parallel with each other and constantly spaced from each other, a plurality of heat-transfer tubes placed between these two headers, and a fin placed between adjacent ones of the plurality of heat-transfer tubes. A parallel heat exchanger may further have a divider that divides an internal space of at least one of these two headers in an axial direction.

Components of a heat exchanger such as a parallel-flow heat exchanger are integrated with each other by brazing with use of a high-temperature furnace. However, the components of the heat exchanger need to be temporarily fixed prior to brazing so that the components of the heat exchanger are not displaced by vibrations or other movements prior to brazing. In particular, when it comes to the temporary fixing of the divider, such a structure is needed that the presence or absence of the divider can be determined from outside the header so that whether the divider is forgotten to be placed into the header can be seen after the temporary fixing of the components of the heat exchanger.

An example of a technology, which has been known, with which to temporarily fix a divider and a header is a heat exchanger in which a divider is temporarily fixed to a header in a direction perpendicular to the axis of a heat-transfer tube (see, for example, Patent Literature 1). In the heat exchanger of Patent Literature 1, the divider is inserted in a slit provided in a header cover that is a component of the header and that is a semicircular component, a caulking nail of the divider is folded toward a header base that is another component, and the divider is thus locked in the header.

CITATION LIST

Patent Literature

Patent Literature 1: Japanese Unexamined Patent Application Publication No. 2002-267388

SUMMARY OF INVENTION

Technical Problem

In a heat exchanger having a pair of headers placed in an up-down direction, for example, the lower header may have two headers arranged in a direction perpendicular to the direction of the tube axis of the header. In this case, for improved performance, the heat exchanger needs to have its ventilation resistance lowered by shortening the width of a fin in a direction perpendicular to the direction of the tube axis of the header, and in order for the width of the fin to be shortened, the width of the header needs to be reduced in a direction perpendicular to the direction of the tube axis of the header. However, as in the case of the heat exchanger of Patent Literature 1, where a divider is temporarily fixed to a header in a direction perpendicular to the axis of a heat-transfer tube, the width of the header widens by the thickness of a caulking nail, with the result that the width of the header is lengthened.

The present disclosure is intended to solve such a problem and has as an object to provide a heat exchanger having a divider in a header but being small in width of the header.

Solution to Problem

A heat exchanger according to an embodiment of the present disclosure is provided with a plurality of heat-transfer tubes placed such that the plurality of heat-transfer tubes are spaced from each other and a header configured to distribute refrigerant to the plurality of heat-transfer tubes. The header has a body section formed in a cylindrical shape and inside which an internal space is defined through which refrigerant flows, and a divider that divides the internal space in the body section in a direction of a tube axis of the header. The body section has a pair of insertion portions that define through holes in both respective side surfaces and that engage with the divider. The divider has a wall portion serving as a wall that divides the internal space in the direction of the tube axis, and a pair of side plate portions that protrude from both respective side surfaces of the wall portion and that are inserted into the pair of respective insertion portions. The pair of side plate portions have plate distal end portions that are distal end portions of the pair of respective side plate portions in a direction in which the pair of side plate portions each protrude and that close the through holes in a state in which the pair of side plate portions are inserted in the pair of respective insertion portions. In a state in which the body section and the divider are combined with each other, the plate distal end portions do not protrude from the pair of respective insertion portions toward an outside of the body section. The plate distal end portions are deformed in such a state that walls of the plate distal end portions are spread out in a direction parallel with the direction of the tube axis such that end faces of the plate distal end portions each form a V-shaped groove, and are in engagement with inner walls of the pair of respective insertion portions inside the through holes defined by the pair of respective insertion portions.

Further, a heat exchanger according to an embodiment of the present disclosure is provided with a plurality of heat-transfer tubes placed such that the plurality of heat-transfer tubes are spaced from each other and a header configured to distribute refrigerant to the plurality of heat-transfer tubes. The header has a body section formed in a cylindrical shape and inside which an internal space is defined through which refrigerant flows, and a divider that divides the internal space in the body section in a direction of a tube axis of the header. The body section has a pair of insertion portions that define through holes in both respective side surfaces and that engage with the divider, and deformed portions formed along the pair of respective insertion portions and formed by being spread out such that portions of walls of the body section each form a groove having a V-shaped cross-section. The divider has a wall portion serving as a wall that divides the internal space in the direction of the tube axis, and a pair of side plate portions that protrude from both respective side surfaces of the wall portion and that are inserted into the pair of respective insertion portions. The pair of side plate portions have plate distal end portions that are distal end portions of the pair of respective side plate portions in a direction in which the pair of side plate portions each protrude and that close the through holes in a state in which the pair of side plate portions are inserted in the pair of respective insertion portions. The header is formed such that in a state in which the body section and the divider are combined with each other, the plate distal end portions do not protrude from the pair of respective insertion portions toward an outside of the body section, that inner walls of the pair of respective insertion portions are deformed by the deformed portions toward centers of the respective through holes such that a size of each of the through holes defined by portions of the inner walls of the pair of insertion portions that face the plate distal end portions is smaller than a size of each of the through holes defined by portions of the inner walls of the insertion portions that face basal portions serving as root portions of the pair of respective side plate portions, and that the plate distal end portions and the inner walls of the pair of respective insertion portions are in engagement with each other inside the through holes defined by the pair of respective insertion portions.

Advantageous Effects of Invention

A heat exchanger according to an embodiment of the present disclosure is formed such that in a state in which the body section and the divider are combined with each other, the plate distal end portions do not protrude from the pair of respective insertion portions toward the outside of the body section. Further, the heat exchanger is formed such that the plate distal end portions of the divider or the deformed portions of the body section are deformed to be spread out, and the plate distal end portions and the inner wads of the pair of respective insertion portions are in engagement with each other inside the through holes defined by the pair of respective insertion portions. The heat exchanger eliminates the need to fix the body section and the divider by causing the divider to protrude from an outer side surface of the header, thus making it possible to, even when the heat exchanger has the divider in the header, make the width of the header smaller than the width of a header that is required to cause the divider to protrude toward the outside of the body section so that the body section and the divider are fixed to each other.

DESCRIPTION OF EMBODIMENTS

Figure 1:
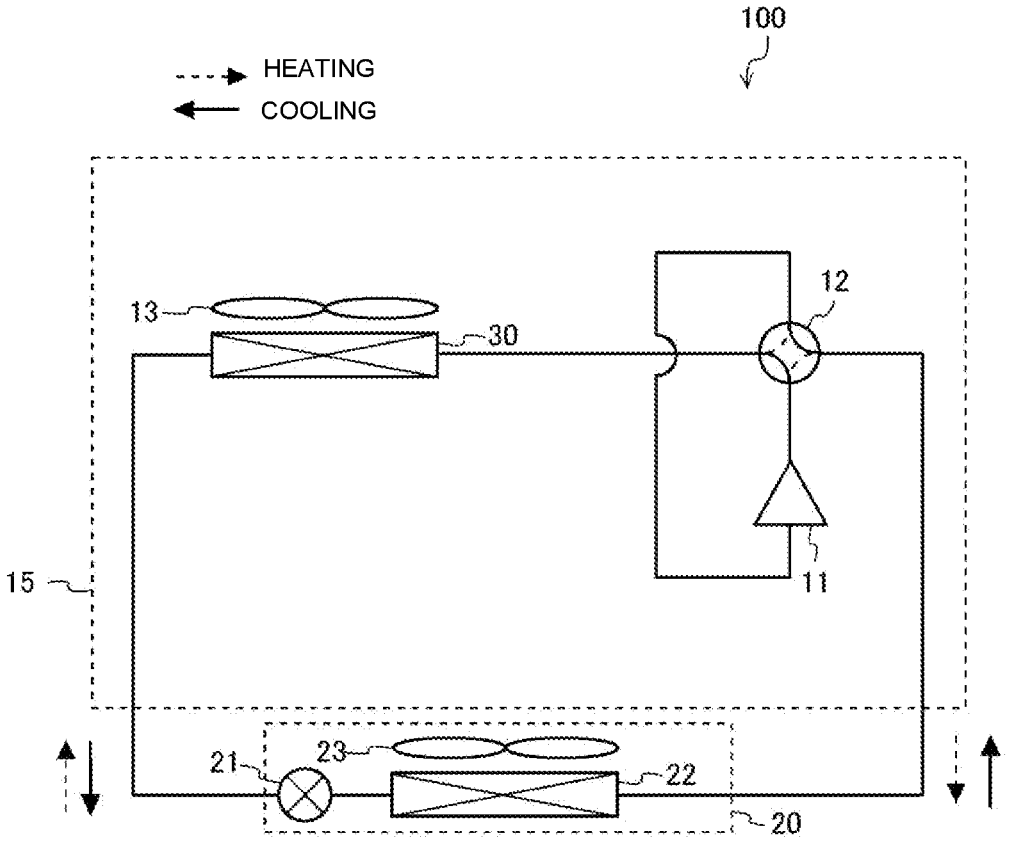
FIG. 1 is a refrigerant circuit diagram of an air-conditioning apparatus provided with a heat exchanger according to Embodiment 1.

The following describes embodiments of the present disclosure with reference to the drawings. Note here that constituent elements given identical reference signs in the following diagrams, including FIG. 1, are identical or equivalent to each other, and these reference signs are adhered to throughout the full text of the embodiments described below. Further, in each embodiment, constituent elements that are identical or equivalent to constituent elements described in a preceding embodiment are given identical reference signs and a description of such constituent elements may be omitted. Moreover, the forms of constituent elements expressed in the full text of the specification are merely examples and are not limited to forms described in the specification. Further, the following embodiments may be partially combined with each other even in a case in which such combinations are not specified, provided no obstacles are brought about to such combinations.

Embodiment 1

<Configuration of Air-Conditioning Apparatus 100>

FIG. 1 is a refrigerant circuit diagram of an air-conditioning apparatus 100 provided with a heat exchanger 30 according to Embodiment 1. In FIG. 1, the solid arrows indicate the flow of refrigerant during cooling operation, and the dashed arrows indicate the flow of refrigerant during heating operation.

As shown in FIG. 1, the air-conditioning apparatus 100 is provided with an outdoor unit 15 and an indoor unit 20, and the heat exchanger 30 according to Embodiment 1 is mounted in the outdoor unit 15. The outdoor unit 15 is provided with a compressor 11, a flow switching device 12, and a fan 13 in addition to the heat exchanger 30. The indoor unit 20 is provided with an expansion device 21, an indoor heat exchanger 22, and an indoor fan 23.

Further, the air-conditioning apparatus 100 is provided with a refrigerant circuit in which the compressor 11, the flow switching device 12, the heat exchanger 30, the expansion device 21, and the indoor heat exchanger 22 are connected to one another by refrigerant pipes and through which refrigerant circulates. The air-conditioning apparatus 100 is enabled to operate both cooling operation and heating operation by switching the flow switching device 12.

The compressor 11 sucks low-temperature and low-pressure refrigerant, compresses the refrigerant thus sucked, and discharges high-temperature and high-pressure refrigerant. The compressor 11 is, for example, an inverter compressor whose capacity, that is, rate of delivery per unit time, is controlled by varying operating frequency.

The flow switching device 12 is for example a four-way valve, and enables switching between cooling operation and heating operation to be done by switching the direction in which refrigerant flows. During cooling operation, the flow switching device 12 makes switching to a state indicated by the solid lines in FIG. 1, and a discharge port of the compressor 11 is thus connected to the heat exchanger 30. Further, during heating operation, the flow switching device 12 makes switching to a state indicated by the dashed lines in FIG. 1, and the discharge port of the compressor 11 is thus connected to the indoor heat exchanger 22.

The heat exchanger 30 exchanges heat between outdoor air and refrigerant flowing through the inside of the heat exchanger 30. During cooling operation, the heat exchanger 30 serves as a condenser configured to condense the refrigerant by rejecting the heat of the refrigerant to the outdoor air. Further, during heating operation, the heat exchanger 30 serves as an evaporator configured to evaporate the refrigerant and cool the outdoor air with the resulting heat of vaporization.

The fan 13 is configured to supply outdoor air to the heat exchanger 30, and by controlling the rotation frequency of the fan 13, the amount of air that is sent to the heat exchanger 30 is adjusted.

The expansion device 21 is for example an electronic expansion valve whose opening degree of expansion can be adjusted, and by adjusting the opening degree, the pressure of refrigerant flowing into the heat exchanger 30 or the indoor heat exchanger 22 is controlled. Although, in Embodiment, the expansion device 21 is provided in the indoor unit 20, the expansion device 21 may be provided in the outdoor unit 15 and is not limited in place of installation.

The indoor heat exchanger 22 exchanges heat between indoor air and refrigerant flowing through the inside of the indoor heat exchanger 22. During cooling operation, the indoor heat exchanger 22 serves as an evaporator configured to evaporate the refrigerant and cool outdoor air with the resulting heat of vaporization. Further, during heating operation, the indoor heat exchanger 22 serves as a condenser configured to condense the refrigerant by rejecting the heat of the refrigerant to outdoor air.

The indoor fan 23 is configured to supply indoor air to the indoor heat exchanger 22, and by controlling the rotation frequency of the indoor fan 23, the amount of air that is sent to the indoor heat exchanger 22 is adjusted.

<Cooling Operation>

Operation of the air-conditioning apparatus 100 is described here. First, cooling operation is described. During cooling operation, refrigerant sucked into the compressor 11 is compressed by the compressor 11 and discharged as high-temperature and high-pressure gas refrigerant. The high-temperature and high-pressure gas refrigerant discharged from the compressor 11 passes through the flow switching device 12 and flows into the heat exchanger 30, which serves as condenser. The refrigerant having flowed into the heat exchanger 30 condenses into liquid refrigerant by exchanging heat with outdoor air sent by the fan 13. The liquid refrigerant flows into the expansion device 21 and is decompressed and expended into low-temperature and low-pressure two-phase gas-liquid refrigerant. The two-phase gas-liquid refrigerant flows into the indoor heat exchanger 22, which serves as an evaporator. The refrigerant having flowed into the indoor heat exchanger 22 evaporates into gas refrigerant by exchanging heat with indoor air sent by the indoor fan 23. At this time, the indoor air is cooled, and indoor cooling is thus executed. After that, the low-temperature and low-pressure gas refrigerant having evaporated passes through the flow switching device 12 and is sucked into the compressor 11.

<Heating Operation>

Next, heating operation is described. During heating operation, refrigerant sucked into the compressor 11 is compressed by the compressor 11 and discharged as high-temperature and high-pressure gas refrigerant. The high-temperature and high-pressure gas refrigerant discharged from the compressor 11 passes through the flow switching device 12 and flows into the indoor heat exchanger 22, which serves as condenser. The refrigerant having flowed into the indoor heat exchanger 22 condenses into liquid refrigerant by exchanging heat with indoor air sent by the indoor fan 23. At this time, the indoor air is heated, and indoor heating is thus executed. The liquid refrigerant flows into the expansion device 21 and is decompressed and expended into low-temperature and low-pressure two-phase gas-liquid refrigerant. The two-phase gas-liquid refrigerant flows into the heat exchanger 30, which serves as an evaporator. The refrigerant having flowed into the heat exchanger 30 evaporates into gas refrigerant by exchanging heat with outdoor air sent by the fan 13. After that, the low-temperature and low-pressure gas refrigerant having evaporated passes through the flow switching device 12 and is sucked into the compressor 11.

<Configuration of Heat Exchanger 30>

Figure 2:
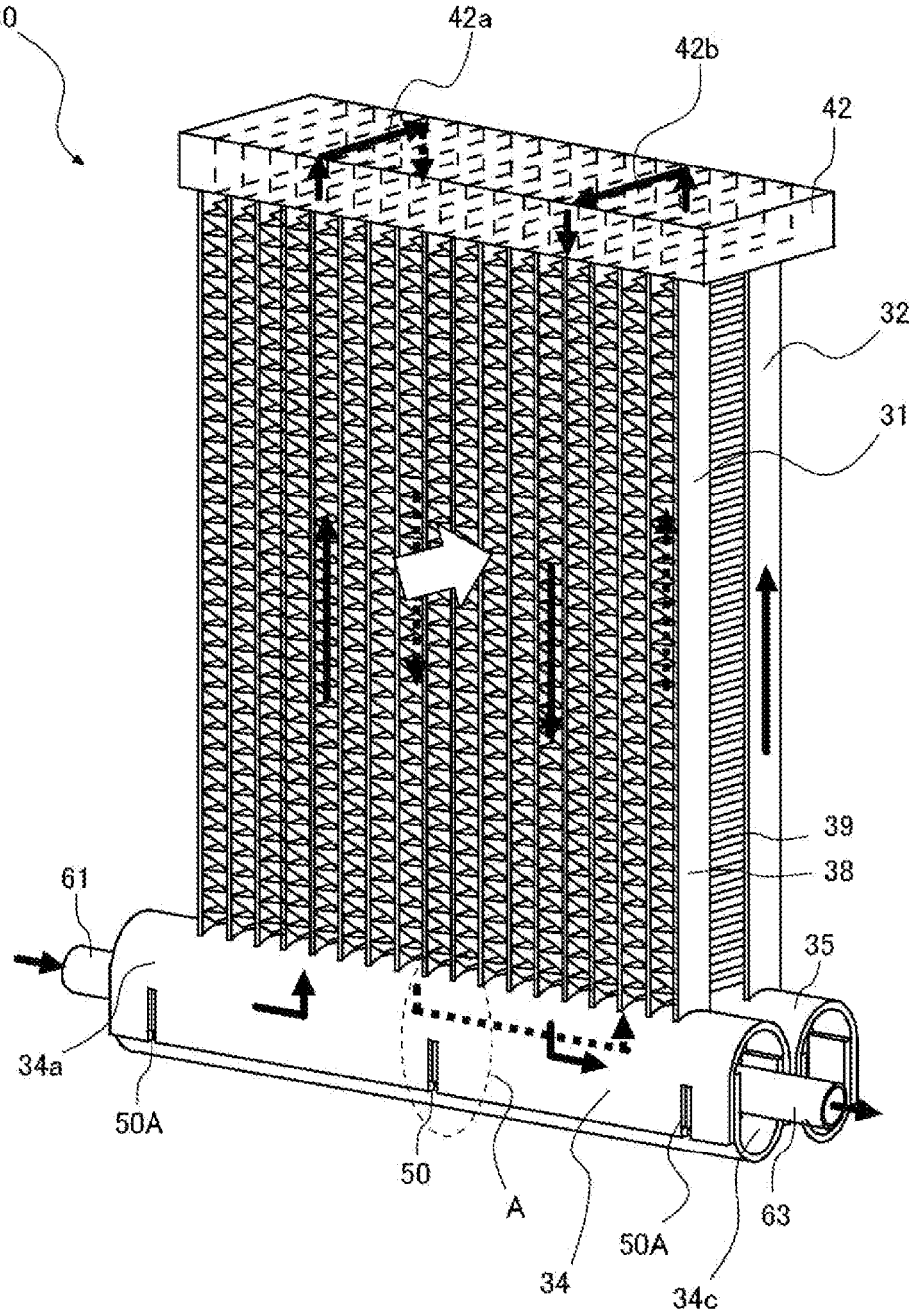
FIG. 2 is a perspective view of the heat exchanger according to Embodiment 1.
Figure 3:
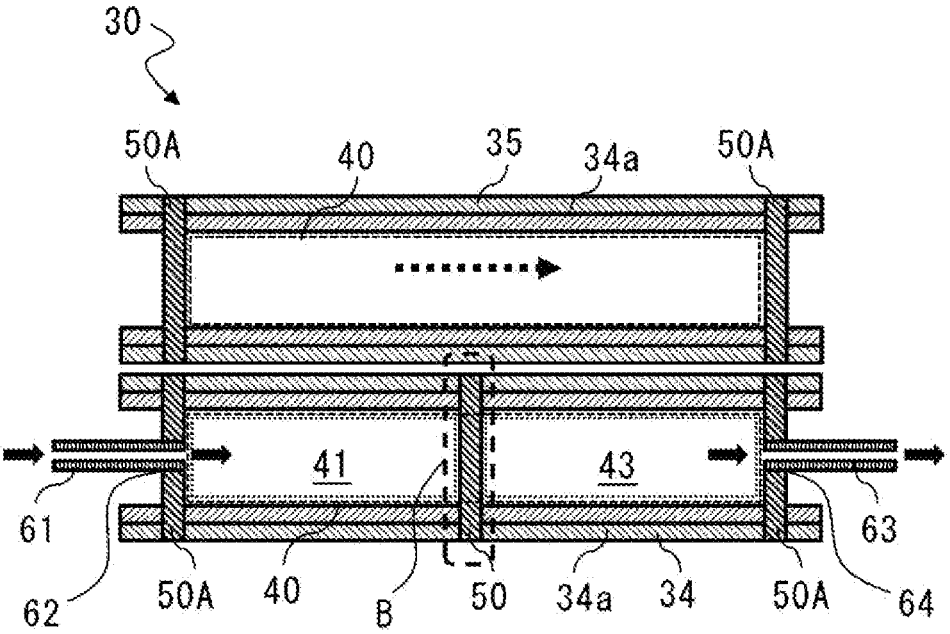
FIG. 3 is a diagram conceptually showing a cross-section taken along the directions of the tube axes of first and second headers of the heat exchanger according to Embodiment 1.

FIG. 2 is a perspective view of the heat exchanger 30 according to Embodiment 1. FIG. 3 is a diagram conceptually showing a cross-section taken along the directions of the tube axes of first and second headers 34 and 35 of the heat exchanger 30 according to Embodiment 1. In FIG. 2, the arrow outlined with a blank inside indicates wind currents generated by the fan 13. Further, in FIGS. 2 and 3, the solid arrows indicate the flow of refrigerant flowing through the first header 34, and the dashed arrows indicate the flow of refrigerant flowing through the second header 35.

As shown in FIG. 2, the heat exchanger 30 has a plurality of heat exchange bodies arranged along the direction in which air flows. Specifically, the heat exchanger 30 has a first heat exchange body 31 placed windward and a second heat exchange body 32 placed leeward. Further, the heat exchanger 30 has a first header 34, a second header 35, and a bridging header 42, which are connected to the first heat exchange body 31 and the second heat exchange body 32. The first heat exchange body 31 and the second heat exchange body 32 each have a plurality of heat-transfer tubes 38 and a plurality of fins 39.

The heat-transfer tubes 38 are for example flat tubes and inside which a plurality of flow passages (not illustrated) through which refrigerant flows are formed. In Embodiment 1, the heat-transfer tubes 38 extend in an up-down direction. The heat-transfer tubes 38 are formed such that refrigerant flows in the up-down direction through the inside of tubes extending in the up-down direction. The up-down direction is for example a vertical direction, but may be a direction inclined to a vertical direction. The heat-transfer tubes 38 may extend in a direction other than the up-down direction. The heat-transfer tubes 38 are horizontally arranged in parallel with each other and spaced from each other. The fins 39 are each placed between the corresponding and adjacent ones of the heat-transfer tubes 38.

The fins 39 are heat-transfer enhancement elements and are each placed between the corresponding and adjacent ones of the plurality of heat-transfer tubes 38. The fins 39 are each connected across the space between the corresponding and adjacent ones of heat-transfer tubes 38 and transfer heat to the heat-transfer tubes 38. The fins 39 are intended to improve heat-exchange efficiency between air and refrigerant, and usable examples of the fins 39 are corrugated fins. However, the fins 39 are not limited to corrugated fins and may for example be other heat-transfer enhancement elements such as plate fins. Further, the first heat exchange body 31 and the second heat exchange body 32 do not need to have the fins 39, as heat exchange between air and refrigerant takes place on the surfaces of the heat-transfer tubes 38.

The first header 34 is connected to a lower end of the first heat exchange body 31. Lower ends of the heat-transfer tubes 38 of the first heat exchange body 31 are directly inserted in the first header 34. The plurality of heat-transfer tubes 38 are connected to the first header 34 and extend upward in a vertical direction. In the air-conditioning apparatus 100, the first header 34 is placed more windward than the second header 35 in the direction in which air sent by the fan 13 flows as indicated by the arrow outlined with a blank inside in FIG. 2.

The first header 34 serves as a distribution mechanism configured to distribute, to the plurality of heat-transfer tubes 38, refrigerant flowing into the first heat exchange body 31. Further, the first header 34 serves as a confluence mechanism where outflows of refrigerant from the plurality of heat-transfer tubes 38 merge with each other when a flow of refrigerant flows out from the first heat exchange body 31, The first header 34 is an element formed in the shape of an elongated cylinder closed at both ends and has a space defined inside the first header 34. As shown in FIGS. 2 and 3, the first header 34 has a body section 34*a*, end plates 50A, an inlet pipe 61, an outlet pipe 63, and a divider 50.

The body section 34*a* is an element formed in the shape of an elongated cylinder and inside which a space is defined through which refrigerant flows. In a cross-section perpendicular to the direction of the tube axis of the body section 34*a*, the body section 34*a* is formed in the shape of an oval. The body section 34*a* needs only be formed in the shape of a cylinder, and in a cross-section perpendicular to the direction of the tube axis of the body section 34*a*, the body section 34*a* may be formed in another shape such as a perfect circle and a polygon. The end plates 50A are each placed at the corresponding one of both ends of the body section 34*a* to seal in refrigerant.

The first header 34 is formed in the shape of a column by a combination of the body section 34*a* and the end plates 50A. Although the first header 34 is placed such that a central axis in a longitudinal direction extends in a horizontal direction, the first header 34 may be placed such that a central axis in a longitudinal direction is inclined to a horizontal direction.

The end plates 50A close openings at both ends of the body section 34*a* formed in the shape of a cylinder. The inlet pipe 61 is connected to the corresponding one of the end plates 50A that serves as a first end of the first header 34 in a longitudinal direction of the first header 34. The corresponding end plate 50A that serves as the first end of the first header 34 has an inlet opening 62 into which the inlet pipe 61 is inserted. The inlet opening 62 is a through hole opened in the corresponding end plate 50A.

The outlet pipe 63 is connected to the corresponding one of the end plates 50A that serves as a second end of the first header 34 in the longitudinal direction of the first header 34. The corresponding end plate 50A that serves as the second end of the first header 34 has an outlet opening 64 into which the outlet pipe 63 is inserted. The outlet opening 64 is a through hole opened in the corresponding end plate 50A.

The inlet pipe 61 is an inlet through which refrigerant flows into the first header 34. Further, the outlet pipe 63 is an outlet through which refrigerant flows out from the first header 34. The inlet pipe 61 is inserted in the inlet opening 62 and passes completely through the corresponding end plate 50A. The outlet pipe 63 is inserted in the outlet opening 64 and passes completely through the corresponding end plate 50A. The first header 34 is connected via the inlet pipe 61 to the refrigerant circuit of the air-conditioning apparatus 100. Further, the first header 34 is connected via the outlet pipe 63 to the refrigerant circuit of the air-conditioning apparatus 100.

The first header 34 defines an internal space 40 separated from a space outside the first header 34 by the body section 34*a* formed in the shape of a cylinder and the end plates 50A closing both ends of the body section 34*a*. The internal space 40 is a space that communicates with intratubular spaces of the heat-transfer tubes 38 and that communicates with intratubular spaces of the inlet pipe 61 and the outlet pipe 63. In the internal space 40 of the first header 34, the divider 50 is provided.

The divider 50 is a plate-shaped element. The divider 50 serves as a wall that separates the internal space 40 of the first header 34 into a plurality of spaces in a direction parallel with the direction of the tube axis of the first header 34. The divider 50 divides the internal space 40 in a direction parallel with the direction of the tube axis of the first header 34 and thus defines a plurality of spaces inside the first header 34. For example, as shown in FIG. 3, the first header 34 has a distribution space 41 and a confluence space 43 defined by the divider 50.

The distribution space 41 is a space in the first header 34 where refrigerant to be distributed to the plurality of heat-transfer tubes 38 is present. The confluence space 43 is a space in the first header 34 where outflows of refrigerant from the plurality of heat-transfer tubes 38 merge with each other, Since the distribution space 41 and the confluence space 43 are separated from each other by the divider 50, refrigerant does not move between the distribution space 41 and the confluence space 43. That is, in the internal space 40 of the first header 34, adjacent spaces separated by the divider 50 do not communicate with each other, and refrigerant thus does not move between the adjacent spaces separated by the divider 50. The first header 34 has at least one divider 50.

Figure 4:
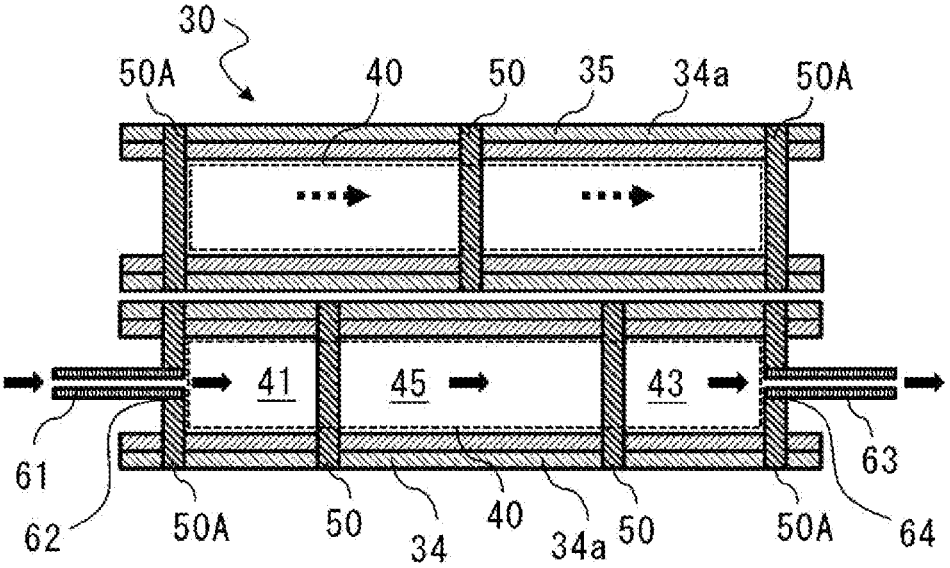
FIG. 4 is a diagram conceptually showing a cross-section taken along the directions of the tube axes of the first and second headers of a modification of the heat exchanger according to Embodiment 1.

FIG. 4 is a diagram conceptually showing a cross-section taken along the directions of the tube axes of the first and second headers 34 and 35 of a modification of the heat exchanger 30 according to Embodiment 1. As shown in FIG. 4, in a case in which the first header 34 has a plurality of dividers 50, the first header 34 may have a confluence and distribution space 45 that serves as a space having the functions of the distribution space 41 and the confluence space 43.

The confluence and distribution space 45 is a space where outflows of refrigerant from the plurality of heat-transfer tubes 38 merge with each other and a space where flows of refrigerant having merged with each other are again distributed to the plurality of heat-transfer tubes 38. The confluence and distribution space 45 is defined between the confluence space 43 and the distribution space 41 in a direction parallel with the direction of the tube axis of the first header 34.

The second header 35 is connected to a lower end of the second heat exchange body 32. Lower ends of the heat-transfer tubes 38 of the second heat exchange body 32 are directly inserted in the second header 35. The plurality of heat-transfer tubes 38 are connected to the second header 35 and extend upward in a vertical direction. The second header 35 is placed parallel to the first header 34. In the air-conditioning apparatus 100, the second header 35 is placed more leeward than the first header 34 in the direction in which air sent by the fan 13 flows as indicated by the arrow outlined with a blank inside in FIG. 2. The second header 35 and the first header 34 are placed at the same height from the ground and placed parallel to each other.

The second header 35 serves as a confluence mechanism where inflows of refrigerant from the plurality of heat-transfer tubes 38 merge with each other when a flow of refrigerant flows in from the first heat exchange body 31. Further, the second header 35 serves as a distribution mechanism configured to distribute, to the plurality of heat-transfer tubes 38, refrigerant flowing out from the second heat exchange body 32 to the first heat exchange body 31.

The second header 35 is an element formed in the shape of an elongated cylinder closed at both ends and has a space defined inside the second header 35. As shown in FIGS. 2 and 3, the second header 35 has the body section 34*a* and the end plates 50A.

The body section 34*a* is an element formed in the shape of an elongated cylinder and has a space defined inside the body section 34*a*. In a cross-section perpendicular to the direction of the tube axis of the body section 34*a*, the body section 34*a* is formed in the shape of an oval. The body section 34*a* needs only be formed in the shape of a cylinder, and in a cross-section perpendicular to the direction of the tube axis of the body section 34*a*, the body section 34*a* may be formed in another shape such as a perfect circle and a polygon. The end plates 50A are each placed at the corresponding one of both ends of the body section 34*a* to seal in refrigerant.

The second header 35 is formed in the shape of a column by a combination of the body section 34*a* and the end plates 50A, Although the second header 35 is placed such that a central axis in a longitudinal direction extends in a horizontal direction, the second header 35 may be placed such that a central axis in a longitudinal direction is inclined to a horizontal direction.

The end plates 50A close openings at both ends of the body section 34*a* formed in the shape of a cylinder. The second header 35 defines an internal space 40 separated from a space outside the second header 35 by the body section 34*a* formed in the shape of a cylinder and the end plates 50A closing both ends of the body section 34*a*. The internal space 40 of the second header 35 communicates with intratubular spaces of the heat-transfer tubes 38.

The internal space 40 of the second header 35 is a space where outflows of refrigerant from the plurality of heat-transfer tubes 38 merge with each other and a space where flows of refrigerant having merged with each other are again distributed to the plurality of heat-transfer tubes 38, Refrigerant flows from the internal space 40 of the first header 34 via the plurality of heat-transfer tubes 38 into the internal space 40 of the second header 35. Further, the refrigerant flows from the internal space 40 of the second header 35 via the plurality of heat-transfer tubes 38 into the internal space 40 of the first header 34.

In the heat exchanger 30 according to Embodiment 1, the second header 35 is not provided with a divider 50; however, as indicated by the first header 34 and the second header 35 of the modification in FIG. 4, the second header 35 may have a divider 50. In a case in which the second header 35 is provided with a divider 50, the divider 50 serves as a wall that separates the internal space 40 of the second header 35 into a plurality of spaces in a direction parallel with the direction of the tube axis of the second header 35. For example, as shown in FIG. 4, the second header 35 may be divided by the divider 50 such that the internal space 40 forms a plurality of compartments. Detailed structures of the first header 34 and the second header 35 will be described later.

In a case in which there are two headers, namely the first header 34 and the second header 35, the bridging header 42 is provided at ends of the plurality of heat-transfer tubes 38 opposite to the ends connected to the two headers. The bridging header 42 causes refrigerant to flow between the plurality of heat-transfer tubes 38 connected to a first one of the two headers, namely the first header 34 and the second header 35, and the plurality of heat-transfer tubes 38 connected to a second one of the two headers, namely the first header 34 and the second header 35.

The bridging header 42 is provided such that the bridging header 42 faces the first header 34 and the second header 35 across the heat-transfer tubes 38. The bridging header 42 is provided at upper ends of the first heat exchange body 31 and the second heat exchange body 32, and into the bridging header 42, upper ends of the plurality of heat-transfer tubes 38 inserted in the first header 34 and the second header 35 are inserted. The plurality of heat-transfer tubes 38 connected to the first header 34 and the second header 35 are coupled to the bridging header 42 located at upper portions of the first header 34 and the second header 35.

In the bridging header 42, a first flow passage 42*a* is formed through which second ends of a plurality of heat-transfer tubes 38 whose first ends communicate with the distribution space 41 of the first header 34 communicate with second ends of a plurality of heat-transfer tubes 38 whose first ends communicate with the internal space 40 of the second header 35. It should be noted that the plurality of heat-transfer tubes 38 communicating with the distribution space 41 of the first header 34 are included in the first heat exchange body 31, and the plurality of heat-transfer tubes 38 communicating with the internal space 40 of the second header 35 are included in the second heat exchange body 32. One or more first flow passages 42*a* may be formed.

Further, in the bridging header 42, a second flow passage 42*b* is formed through which second ends of a plurality of heat-transfer tubes 38 whose first ends communicate with the internal space 40 of the second header 35 communicate with second ends of a plurality of heat-transfer tubes 38 whose first ends communicate with the confluence space 43 of the first header 34. It should be noted that the plurality of heat-transfer tubes 38 communicating with the confluence space 43 of the first header 34 are included in the first heat exchange body 31, and the plurality of heat-transfer tubes 38 communicating with the internal space 40 of the second header 35 are included in the second heat exchange body 32. One or more second flow passages 42*b* may be formed.

The bridging header 42 causes refrigerant flowing through the first heat exchange body 31 to flow through the second heat exchange body 32, which faces the first heat exchange body 31 in a transverse direction, and causes refrigerant flowing through the second heat exchange body 32 to flow through the first heat exchange body 31, which faces the second heat exchange body 32 in a transverse direction. The bridging header 42 forms a flow passage through which heat-transfer tubes 38 that are placed and face each other in a transverse direction communicate with each other.

The plurality of heat-transfer tubes 38, the fins 39, the first header 34, the second header 35, the bridging header 42, the inlet pipe 61, and the outlet pipe 63 are all made of aluminum and joined to each other by brazing. Further, a header base 9, a header cover 10, and the divider 50 are all made of aluminum and joined to each other by brazing. It should be noted that plurality of heat-transfer tubes 38, the fins 39, the first header 34, the second header 35, the bridging header 42, the inlet pipe 61, and the outlet pipe 63 are not limited to being made of aluminum but may be formed by another metal. Further, the header base 9, the header cover 10, and the divider 50 are not limited to being made of aluminum but may be formed by another metal.

<Operation of Heat Exchanger 30>

As shown in FIGS. 2 and 3, refrigerant flowing through the inside of the heat exchanger 30 flows through the inlet pipe 61, the first header 34, the first heat exchange body 31, the bridging header 42, the second heat exchange body 32, and the second header 35 in sequence. After that, the refrigerant having flowed into the second header 35 flows through the second heat exchange body 32, the bridging header 42, the first heat exchange body 31, the first header 34, and the outlet pipe 63 in sequence.

More particularly, the refrigerant flows from outside the heat exchanger 30 through the inlet pipe 61 into the distribution space 41, which is the internal space 40 of the first header 34. The refrigerant having flowed into the distribution space 41 flows through the insides of heat-transfer tubes 38 that are included in the first heat exchange body 31 and communicate with the distribution space 41 and flows into the first flow passage 42*a* of the bridging header 42. The refrigerant having flowed into the first flow passage 42*a* passes through heat-transfer tubes 38 of the second heat exchange body 32 that communicate with the first flow passage 42*a* and flows into the internal space 40 of the second header 35.

The refrigerant having flowed into the internal space 40 of the second header 35 flows through the insides of heat-transfer tubes 38 included in the second heat exchange body 32 whose second ends communicate with the second flow passage 42*b* and flows into the second flow passage 42*b* of the bridging header 42. The refrigerant having flowed into the second flow passage 42*b* passes through heat-transfer tubes 38 of the first heat exchange body 31 that communicate with the second flow passage 42*b* and flows into the confluence space 43, which is the internal space 40 of the first header 34. The refrigerant having flowed into the confluence space 43 of the first header 34 passes through the outlet pipe 63 and flows out to outside the heat exchanger 30.

As shown in FIGS. 2 and 3, the heat exchanger 30 according to Embodiment 1 is structured such that the first header 34 is provided with the divider 50, the inlet pipe 61, and the outlet pipe 63 and the second header 35 is not provided with a divider 50, an inlet pipe 61, or an outlet pipe 63. However, the heat exchanger 30 is not limited to such a structure, but the structure of the first header 34 and the structure of the second header 35 may be exchanged with each other. That is, the heat exchanger 30 may be structured such that the second header 35 is provided with the divider 50, the inlet pipe 61, and the outlet pipe 63 and the first header 34 is not provided with a divider 50, an inlet pipe 61, or an outlet pipe 63.

Further, instead of being formed such that only either the first header 34 or the second header 35 has a divider 50, the heat exchanger 30 may be formed such that, as shown in FIG. 4, both the first header 34 and the second header 35 each have a divider 50. Further, the inlet pipe 61 may be provided in one header and the outlet pipe 63 may be provided in another header. For example, the inlet pipe 61 may be provided in the first header 34, and the outlet pipe 63 may be provided in the second header 35.

<Detailed Configuration of First Header 34>

Figure 5:
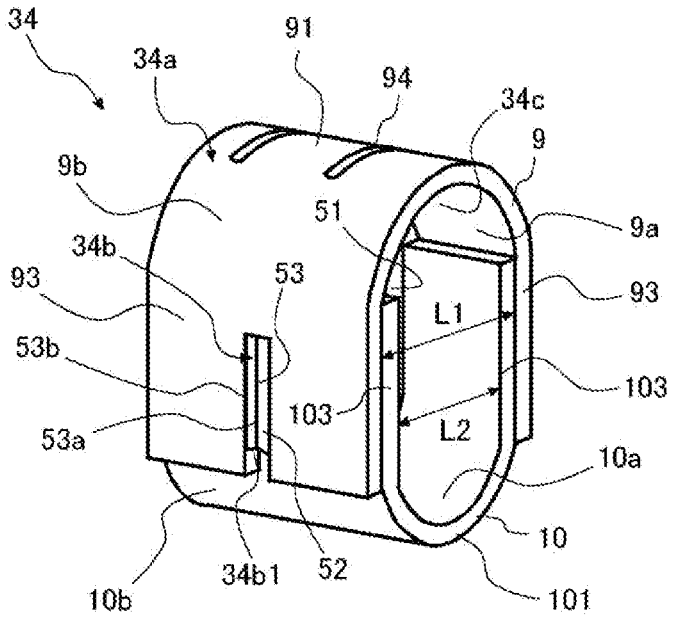
FIG. 5 is an enlarged perspective view of the first header in part A of FIG. 2.
Figure 6:
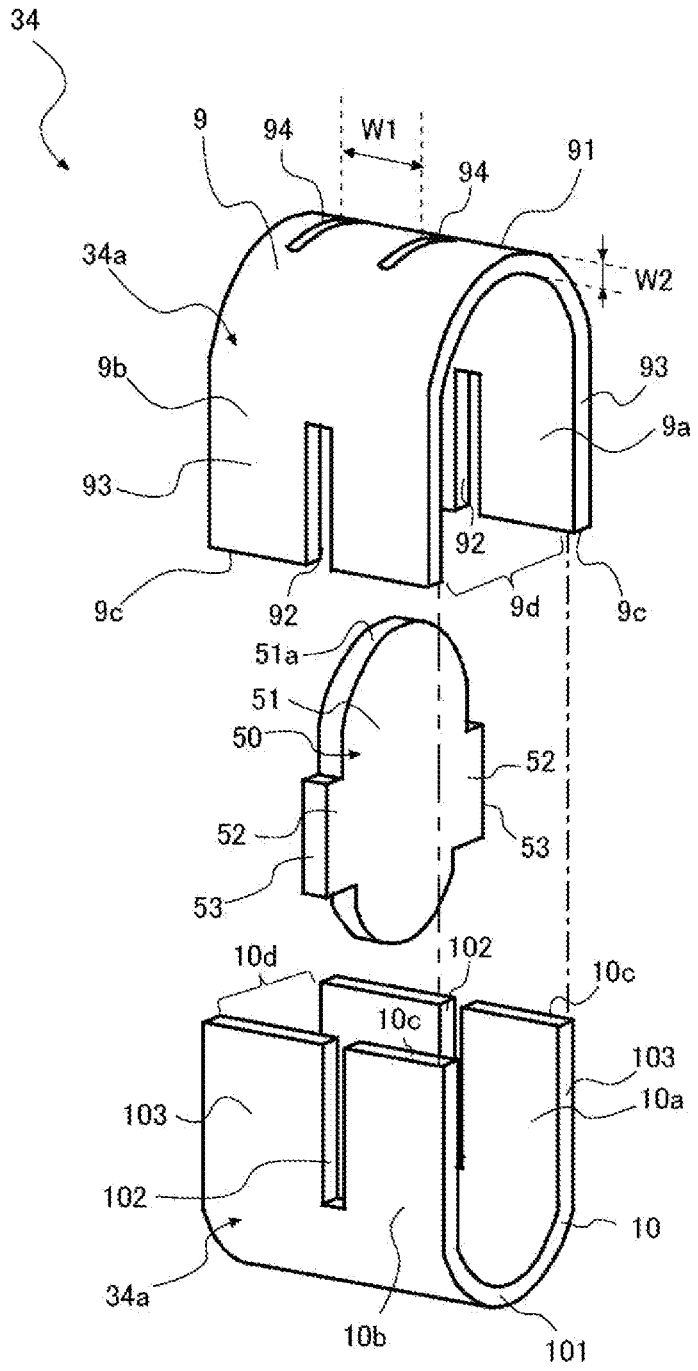
FIG. 6 is an exploded perspective view of the first header according to Embodiment 1.
Figure 7:
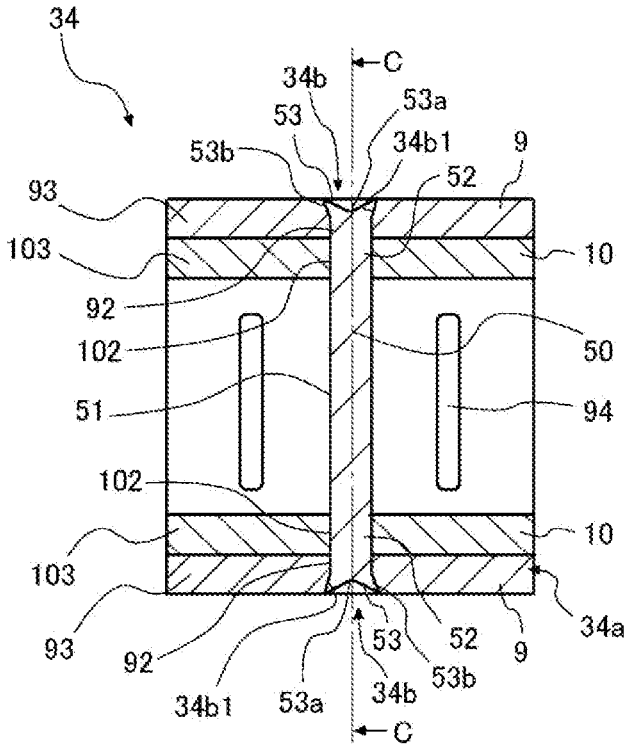
FIG. 7 is a cross-sectional view of the first header as taken along the direction of the tube axis of the first header and a partial cross-sectional view conceptually showing a cross-section of the first header in part B of FIG. 3.
Figure 8:
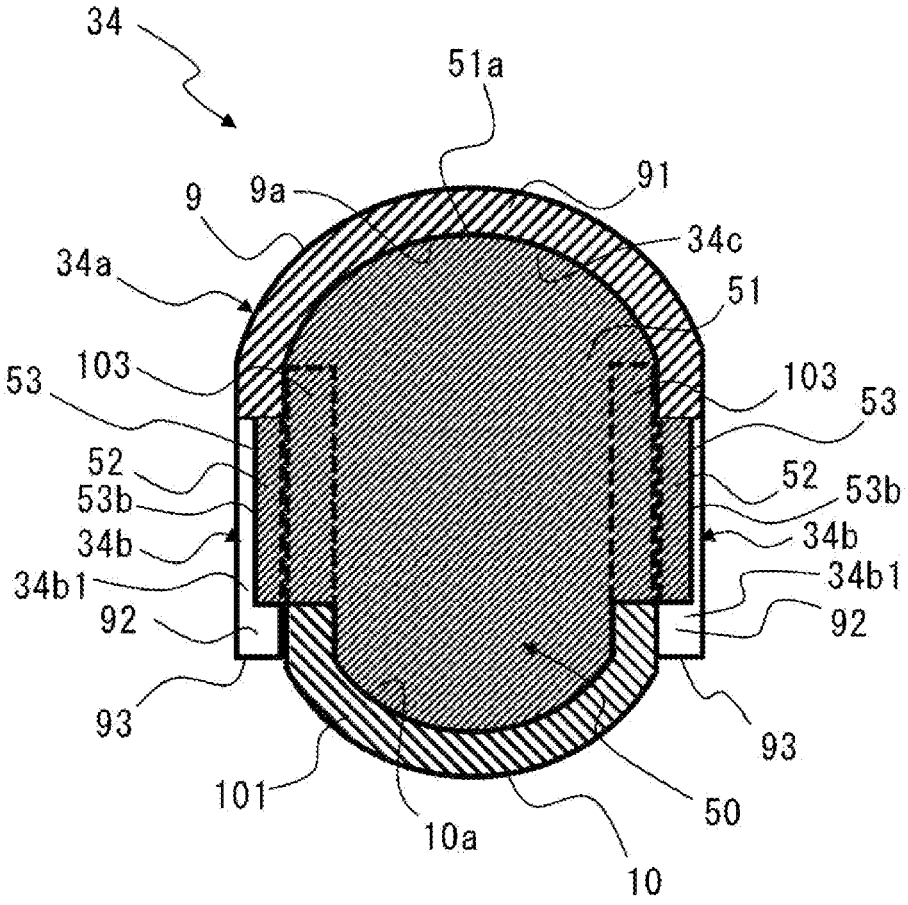
FIG. 8 is a cross-sectional view conceptually showing a cross-section of the first header as taken along line C-C in FIG. 7.

FIG. 5 is an enlarged perspective view of the first header 34 in part A of FIG. 2. FIG. 6 is an exploded perspective view of the first header 34 according to Embodiment 1. FIG. 7 is a cross-sectional view of the first header 34 as taken along the direction of the tube axis of the first header 34 and a partial cross-sectional view conceptually showing a cross-section of the first header 34 in part B of FIG. 3. FIG. 8 is a cross-sectional view conceptually showing a cross-section of the first header 34 as taken along line C-C in FIG. 7. A detailed configuration of the first header 34 is described with reference to FIGS. 5 to 8. It should be noted that FIG. 7 shows the locations of connecting ports 94 for the heat-transfer tubes 38. Further, FIG. 8 uses dashed lines to indicate elements situated behind the divider 50. It should be noted that although the following description deals with the structure of the first header 34, the same applies to the basic configuration of the second header 35. In a case in which the second header 35 does not have a divider 50, the structure of the divider 50 in the following description may correspond to the structures of the end plates 50A.

The body section 34*a* of the first header 34 has the header base 9 and the header cover 10. The header base 9 and the header cover 10 are placed and face each other in a direction in which the heat-transfer tubes 38 extend. The body section 34*a* of the first header 34 is formed in the shape of a cylinder by a combination of the header base 9 and the header cover 10.

As shown in FIG. 5, the body section 34*a* is formed in the shape of a cylinder by a combination of the header base 9 and the header cover 10, and both ends in a longitudinal direction of the header base 9 and the header cover 10 formed in the shape of a cylinder are closed by the end plates 50A. The body section 34*a* is formed in the shape of a column by a combination of the header base 9, the header cover 10, and the end plates 50A.

To the header base 9, the plurality of heat-transfer tubes 38 are connected. The header base 9 is an elongated element and has a U-shaped cross-section perpendicular to the direction of the tube axis of the first header 34, that is, a longitudinal direction. The header base 9 is formed in such a shape that U-shaped portions extend in a longitudinal direction. A U-shaped inner wall surface is a base inner wall surface 9*a* of the header base 9, and a U-shaped outer wall surface is a base outer wall surface 9*b* of the header base 9. That is, in the header base 9, the base inner wall surface 9*a* and the base outer wall surface 9*b* form surfaces that are opposite to each other.

The header base 9 has a pair of base side surface portions 93 forming plate surfaces that face each other and a top surface portion 91 formed to provide a cross-link between ends of the pair of base side surface portions 93 and connected to the plurality of heat-transfer tubes 38. As shown in FIG. 6, in the header base 9, the top surface portion 91 forms a curved portion, and the base side surface portions 93 form tabular portions. In a U-shaped cross-section perpendicular to the direction of the tube axis of the first header 34, the top surface portion 91 is an arc-shaped portion, and the base side surface portions 93 are linearly-shaped portions.

The top surface portion 91 is cross-linked at upper ends of the two base side surface portions 93 and curved convexly toward the outside of the body section 34*a*. In the heat exchanger 30, the top surface portion 91 is curved convexly toward the bridging header 42. By having the top surface portion 91, the header base 9 is formed to be at least partially curved convexly away from the header cover 10. It should be noted that the top surface portion 91 is not limited to being structured to be curved convexly toward the outside of the body section 34*a* but may be formed in a tabular shape.

The two base side surface portions 93 are formed such that their respective surfaces included in the base inner wall surface 9*a* face each other, and also extend substantially parallel to the direction of the tube axis. The top surface portion 91 and the two base side surface portions 93 are integrally formed. In a cross-section perpendicular to the longitudinal direction of the header base 9, the base side surface portions 93 are provided at both respective ends of the arc-shaped top surface portion 91.

The surfaces included in the base inner wall surface 9*a* of the two base side surface portions 93 face and are in contact with surfaces included in a cover outer wall surface 10*b* of cover side surface portions 103 of the header cover 10, which will be described later. The two base side surface portions 93 are joined to the respective cover side surface portions 103 of the header cover 10.

The connecting ports 94, into which the heat-transfer tubes 38 are inserted, are formed in the top surface portion 91 of the header base 9. The connecting ports 94 are a plurality of through holes defined along the longitudinal direction of the header base 9. In the body section 34*a*, the plurality of connecting ports 94 into each of which the corresponding one of the plurality of heat-transfer tubes 38 is inserted are formed and spaced from each other in the direction of the tube axis. The distance W1 (see FIG. 6) between adjacent ones of the plurality of connecting ports 94 is four times or less as great as the plate thickness W2 of the header base 9. The heat-transfer tubes 38 are inserted in the connecting ports 94 and pass completely through the top surface portion 91 of the header base 9. The heat-transfer tubes 38 inserted in the connecting ports 94 are joined to and retained by the header base 9.

Note here that in a U-shaped cross-section perpendicular to the direction of the tube axis of the first header 34, an opening defined between base distal end portions 9*c* of the two base side surface portions 93 is referred to as "base opening 9*d*". The base distal end portions 9*c* are ends of the base side surface portions 93 located opposite to the top surface portion 91.

The pair of base side surface portions 93 are each formed in a plate shaped and have respective base slits 92 that define holes extending from ends opposite to the top surface portion 91 toward the top surface portion 91. The base slits 92 are formed to extend from the base distal end portions 9*c* toward the top surface portion 91. The base slits 92 define holes passing completely through the base side surface portions 93. The base slits 92 of the header base 9 are located at the ends of the respective two base side surface portions 93 opposite to the top surface portion 91. The base slits 92 of the header base 9 define through holes in both respective side surfaces.

The header cover 10 is combined with the header base 9 to define the internal space 40 of the first header 34 together with the header base 9. The header cover 10 is an elongated element and has a U-shaped cross-section perpendicular to the direction of the tube axis of the first header 34, that is, a longitudinal direction. The header cover 10 is formed in such a shape that U-shaped portions extend in a longitudinal direction. A U-shaped inner wall surface is a cover inner wall surface 10*a* of the header cover 10, and a U-shaped outer wall surface is a cover outer wall surface 10*b* of the header cover 10. That is, in the header cover 10, the cover inner wall surface 10*a* and the cover outer wall surface 10*b* form surfaces that are opposite to each other.

The header cover 10 has a pair of cover side surface portions 103 forming plate surfaces that face each other and a bottom surface portion 101 that is formed to provide a cross-link between ends of the pair of cover side surface portions 103 and that faces the top surface portion 91 in the body section 34*a*, In the header cover 10, the bottom surface portion 101 forms a curved portion, and the cover side surface portions 103 form tabular portions. In a U-shaped cross-section perpendicular to the direction of the tube axis of the first header 34, the bottom surface portion 101 is an arc-shaped portion, and the cover side surface portions 103 are linearly-shaped portions.

The bottom surface portion 101 is cross-linked at lower ends of the two cover side surface portions 103 and curved convexly toward the outside of the body section 34*a*, In the heat exchanger 30, the bottom surface portion 101 is curved convexly away from the bridging header 42. By having the bottom surface portion 101, the header cover 10 is formed to be at least partially curved convexly away from the header base 9. It should be noted that the bottom surface portion 101 is not limited to being structured to be curved convexly toward the outside of the body section 34*a* but may be formed in a tabular shape.

The two cover side surface portions 103 are formed such that their respective surfaces included in the cover inner wall surface 10*a* face each other, and also extend substantially parallel to the direction of the tube axis. The bottom surface portion 101 and the two cover side surface portions 103 are integrally formed. In a cross-section perpendicular to a longitudinal direction of the header cover 10, the cover side surface portions 103 are provided at both respective ends of the arc-shaped bottom surface portion 101.

The surfaces included in the cover outer wall surface 10*b* of the two cover side surface portions 103 face and are in contact with the surfaces included in the base inner wall surface 9*a* of the base side surface portions 93 of the header base 9. The two cover side surface portions 103 are joined to the respective base side surface portions 93 of the header base 9.

Note here that in a U-shaped cross-section perpendicular to the direction of the tube axis of the first header 34, an opening defined between cover distal end portions 10*c* of the two cover side surface portions 103 is referred to as "cover opening 10*d*". The cover distal end portions 10*c* are ends of the cover side surface portions 103 located opposite to the bottom surface portion 101.

The pair of cover side surface portions 103 are each formed in a plate shaped and have respective cover slits 102 that define holes extending from ends opposite to the bottom surface portion 101 toward the bottom surface portion 101. The cover slits 102 are formed to extend from the cover distal end portions 10*c* toward the bottom surface portion 101. The cover slits 102 define holes passing completely through the cover side surface portions 103. The cover slits 102 of the header cover 10 are located at the ends of the two cover side surface portions 103 opposite to the bottom surface portion 101. The cover slits 102 of the header cover 10 define through holes in both respective side surfaces.

The header base 9 and the header cover 10 are combined with each other in a direction in which the base opening 9*d* and the cover opening 10*d* face each other. In the first header 34 according to Embodiment 1, the header cover 10 is inserted in the base opening 9*d* of the header base 9 in a state in which the header base 9 and the header cover 10 are combined with each other. In a state in which the header base 9 and the header cover 10 are combined with each other, the distance L1 between the surfaces included in the base inner wall surface 9*a* of the two opposite base side surface portions 93 is greater than the distance L2 between the surfaces included in the cover inner wall surface 10*a* of the two opposite cover side surface portions 103.

As shown in FIG. 5, in a state in which the header base 9 and the header cover 10 are combined with each other, the base inner wall surface 9*a* of the top surface portion 91 and the cover inner wall surface 10*a* of the bottom surface portion 101 face each other. Further, in a state in which the header base 9 and the header cover 10 are combined with each other, the base side surface portions 93 and the cover side surface portions 103 face and are in contact with each other. In this state, the surfaces included in the base inner wall surface 9*a* of the base side surface portions 93 and the surfaces included in the cover outer wall surface 10*b* of the cover side surface portions 103 face and are in contact with each other. That is, the body section 34*a* is formed such that the surfaces included in the base inner wall surface 9*a* of the pair of base side surface portions 93 and the surfaces included in the cover outer wall surface 10*b* of the pair of cover side surface portions 103 are in contact with each other.

As shown in FIG. 7, in a state in which the header base 9 and the header cover 10 are combined with each other, the base slits 92 and the cover slits 102 overlap each other. The body section 34*a* has insertion portions 34*b* formed from inside toward outside the body section 34*a* by the base slits 92 and the cover slits 102 overlapping each other.

The insertion portions 34*b* of the body section 34*a* are through holes defined in the body section 34*a*, In the insertion portions 34*b*, side plate portions 52 of the divider 50, which will be described later, are inserted, and the insertion portions 34*b* engage with the divider 50. The body section 34*a* has a pair of the insertion portions 34*b* that define through holes in wall portions serving as both side surfaces of the body section 34*a* and facing each other and engage with the divider 50.

As shown in FIGS. 6 and 8, the divider 50 has a wall portion 51 and the side plate portions 52. The wall portion 51 is a plate-shaped element and is a portion of the divider 50 serving as a wall that mainly divides the internal space 40 of the body section 34*a* in the direction of the tube axis. When seen in a direction parallel with the direction of the tube axis of the first header 34, the wall portion 51 is formed in the same shape as the shape of the internal space 40. That is, when seen in a direction parallel with the direction of the tube axis of the first header 34, an outer edge 51*a* of the wall portion 51 is formed in a shape along an inner wall 34*c* of the body section 34*a*.

In the first header 34, the outer edge 51*a* of the wall portion 51 is in contact with the inner wall 34*c* of the body section 34*a*. In the first header 34 of the heat exchanger 30 according to Embodiment 1, the inner wall 34*c*, with which the divider 50 is in contact, of the body section 34*a* includes the base inner wall surface 9*a* of the header base 9 and the cover inner wall surface 10*a* of the header cover 10.

The side plate portions 52 are portions protruding from the wall portion 51 and are portions protruding from the outer edge 51*a* of the wall portion 51. The divider 50 has a pair of side plate portions 52 protruding from both respective side surfaces of the wall portions 51. The pair of side plate portions 52 each protrude from the wall portion 51 in a direction perpendicular to the tube axis of the first header 34. The side plate portions 52 of the divider 50 are inserted in the insertion portions 34*b* of the body section 34*a*. The side plate portions 52 are inserted in the insertion portions 34*b* of the body section 34*a* and are used for the temporary fixing of the divider 50 and the body section 34*a* to each other.

The pair of side plate portions 52 have plate distal end portions 53 that are distal ends of the pair of side plate portions 52 in a direction in which the pair of side plate portions 52 each protrude and that, in a state in which the plate distal end portions 53 are inserted in the pair of respective insertion portions 34*b*, close the through holes defined by the insertion portions 34*b*. In a state in which the plate distal end portions 53 are inserted in the insertion portions 34*b*, the plate distal end portions 53 are formed to extend along the hole shapes of the insertion portions 34*b*. The plate distal end portions 53 form distal end walls of the side plate portions 52 in the direction in which the pair of side plate portions 52 each protrude and include distal end faces of the side plate portions 52.

In a state in which the side plate portions 52 are inserted in the insertion portions 34*b*, the plate distal end portions 53 serve as portions of outer wall surfaces of the body section 34*a*. In the heat exchanger 30 according to Embodiment 1, as shown in FIGS. 5 and 7, the plate distal end portions 53 are used to close at least portions of the base slits 92 formed in the header base 9.

In a state in which the body section 34*a* and the divider 50 are combined with each other, the plate distal end portions 53 do not protrude from the pair of respective insertion portions 34*b* toward the outside of the body section 34*a*. Further, the plate distal end portions 53 are deformed in such a state that walls of the plate distal end portions 53 are spread out in a direction parallel with the direction of the tube axis of the first header 34 such that end faces of the plate distal end portions 53 each form a V-shaped groove. Since the plate distal end portions 53 are deformed in a state in which the plate distal end portions 53 are spread out in a direction parallel with the direction of the tube axis, the plate distal end portions 53 are in engagement with inner walls 34*b*1 of the pair of respective insertion portions 34*b* inside the through holes defined by the pair of respective insertion portions 34*b*.

By being deformed by pressing with a tool in the insertion portions 34*b*, the plate distal end portions 53 have its distal end faces spread out such that the side plate portions 52 of the divider 50 and the insertion portions 34*b* come into intimate contact with each other. By the plate distal end portions 53 having its distal end faces spread out, the inner walls 34*b*1 may be spread out such that the insertion portions 34*b* increase in opening size, and the outer edges 53*b* of the plate distal end portions 53 thus deformed and the inner walls 34*b*1 of the insertion portions 34*b* may fit each other. It should be noted that the plate distal end portions 53 thus spread out come into intimate contact with the base slits 92 of the header base 9 to lock the divider 50 and the header base 9 with each other.

In a state in which, in the first header 34, the body section 34*a* and the divider 50 are temporarily fixed to each other, the plate distal end portions 53 of the divider 50 are formed in a state in which the plate distal end portions 53 are spread out and are each wider than the corresponding one of basal portions serving as root portions of the side plate portions 52. Since the plate distal end portions 53 are formed in a state in which the plate distal end portions 53 are spread out in the insertion portions 34*b*, the outer edges 53*b* of the plate distal end portions 53 come into intimate contact with the inner walls 34*b*1 inside the insertion portions 34*b*, and the side plate portions 52 are thus fixed to the inner walls 34*b*1 of the insertion portions 34*b*.

By being deformed by pressing, for example, with a V-topped die, the plate distal end portions 53 in the insertion portions 34*b* have its distal end faces split and spread out to right and left, and the plate distal end portions 53 spread out to right and left thus come into intimate contact with the inner walls 34*b*1 of the insertion portions 34*b*. It should be noted that the term "right and left" here means a direction parallel with the direction of the tube axis of the first header 34.

Since the plate distal end portions 53 are deformed by pressing with a V-topped die, the plate distal end portions 53 have groove portions 53*a* depressed toward the wall portion 51. The groove portions 53*a* are formed to extend in a direction perpendicular to the direction of the tube axis of the first header 34. It should be noted that a direction in which the groove portions 53*a* extend is a direction parallel with the direction in which the heat-transfer tubes 38 extend in the first header 34.

The divider 50 is temporarily fixed to the header base 9 by the distal end faces of the plate distal end portions 53 being each spread out, for example, into a V shape and the side plate portions 52 corning into intimate contact with the insertion portion 34*b*. When seen in a direction parallel with the direction in which the heat-transfer tubes 38 extend, the plate distal end portions 53 are each deformed in a V shape in a state in which the plate distal end portions 53 are deformed.

In a direction perpendicular to the direction of the tube axis of the first header 34, the plate distal end portions 53 inserted in the insertion portions 34*b* may be formed into a state in which only some portions of the insertion portions 34*b* are spread out or may be formed into a state in which all portions of the insertion portions 34*b* are spread out. In FIG. 5, the plate distal end portions 53 are deformed in all portions of side surfaces of the divider 50. However, as long as the divider 50 and the header base 9 of the body section 34*a* are temporarily fixed to each other, the plate distal end portions 53 may be partially deformed in respective length directions of the side plate portions 52.

In a case in which the plate distal end portions 53 in the insertion portions 34*b* are deformed by pressing with a V-topped die, in a direction perpendicular to the direction of the tube axis of the first header 34, the groove portions 53*a* may be formed only in some portions of the plate distal end portions 53 situated in the insertion portions 34*b*. Alternatively, in a direction perpendicular to the direction of the tube axis of the first header 34, the groove portions 53*a* may be formed in all portions of the plate distal end portions 53 situated in the insertion portions 34*b*.

<Application of Detailed Configuration of First Header 34>

In the description of the detailed configuration of the first header 34, the relationship between the body section 34*a* and the divider 50 has been described. This relationship can be applied to a relationship between the body section 34*a* and the end plates 50A. That is, the end plates 50A may have the aforementioned structure of the divider 50. While the aforementioned structure of the first header 34 is intended for the temporary fixing of the body section 34*a* and the divider 50 to each other, it may also be used for the temporary fixing of the body section 34*a* and the end plates 50A to each other. Commonality of structures between the temporary fixing of the body section 34*a* and the divider 50 to each other and the temporary fixing of the body section 34*a* and the end plates 50A to each other enables commonality of components between the divider 50 and the end plates 50A.

The relationship between the body section 34*a* and the divider 50 has been described as the structure of the first header 34. However, in a case in which the second header 35 has a divider 50, the aforementioned relationship between the body section 34*a* and the divider 50 can be applied to the relationship between the body section 34*a* and the divider 50 of the second header 35.

In the description of the detailed configuration of the first header 34, the header cover 10 is placed inside the header base 9. Alternatively, the header cover 10 may be placed outside the header base 9. In this case, the body section 34*a* is formed such that the base outer wall surface 9*b* of the header base 9 and the cover inner wall surface 10*a* of the header cover 10 are in contact with each other. The spread-out plate distal end portions 53 come into intimate contact with the cover slits 102 of the header cover 10 to lock the divider 50 and the header cover 10 with each other.

<Working Effects of Heat Exchanger 30>

Figure 9:
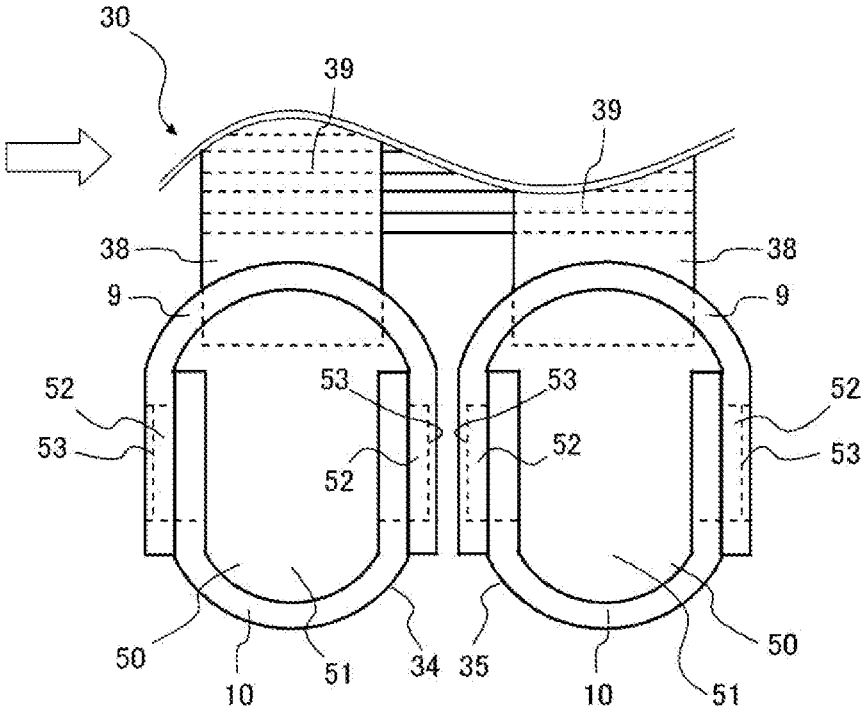
FIG. 9 is a side view conceptually showing a relationship between a divider and a body section of the heat exchanger according to Embodiment 1.

FIG. 9 is a side view conceptually showing a relationship between the divider 50 and the body section 34*a* of the heat exchanger 30 according to Embodiment 1. It should be noted that FIG. 9 shows a heat exchanger 30 in which a divider 50 is used in the second header 35 too. In FIG. 9, the arrow outlined with a blank inside indicates wind currents generated by the fan 13.

The heat exchanger 30 according to the present disclosure is formed such that in a state in which the body section 34*a* and the divider 50 are combined with each other, the plate distal end portions 53 do not protrude from the pair of respective insertion portions 34*b* toward the outside of the body section 34*a*. Further, the plate distal end portions 53 are deformed in such a state that the walls of the plate distal end portions 53 are spread out in a direction parallel with the direction of the tube axis such that the end faces each form a V-shaped groove, and are in engagement with the inner walls 34*b*1 of the pair of respective insertion portions 34*b* inside the through holes defined by the pair of respective insertion portions 34*b*. Therefore, the heat exchanger 30 eliminates the need to fix the body section 34*a* and the divider 50 by causing the divider 50 to protrude from an outer side surface of the first header 34.

By having such a configuration, the heat exchanger 30 makes it possible to, even when the heat exchanger 30 has the divider 50 in the first header 34, make the width of the first header 34 smaller than the width of a header that is required to cause the divider 50 to protrude toward the outside of the body section 34*a* so that the body section 34*a* and the divider 50 are fixed to each other. The width of the first header 34 is the length of the first header 34 in the direction in which air passing through the heat exchanger 30 flows. Further, when such a configuration is applied to the second header 35, the heat exchanger 30 makes it possible to reduce the width of the second header 35 even when the heat exchanger 30 has a divider 50 in the second header 35. Further, when the aforementioned configuration is applied to both the first header 34 and the second header 35, the heat exchanger 30 makes it possible to reduce the width of the heat exchanger 30 and reduce installation space for the heat exchanger 30.

Further, the plate distal end portions 53 are deformed in such a state that the walls of the plate distal end portions 53 are spread out in a direction parallel with the direction of the tube axis such that the end faces each form a V-shaped groove, and are in engagement with the inner walls 34*b*1 of the pair of respective insertion portions 34*b* inside the through holes defined by the pair of respective insertion portions 34*b*. Therefore, the heat exchanger 30 makes it possible to reduce the gaps between the insertion portions 34*b* and the side plate portions 52 and ensure the airtightness of the first header 34 or the second header 35. The heat exchanger 30 makes it possible to, by inserting the side plate portions 52 into the insertion portions 34*b* and then deforming the plate distal end portions 53 into a state in which the plate distal end portions 53 are spread out, ensure the airtightness of the first header 34 or the second header 35 without the need to open great gaps between the insertion portions 34*b* and the side plate portions 52 in advance.

Further, the heat exchanger 30 is formed such that the body section 34*a* is formed by a combination of the header base 9 and the header cover 10. This makes it possible to place the divider 50 between the header base 9 and the header cover 10, which are divided from each other, and allows a worker to easily attach the divider 50 to the body section 34*a*.

Further, the insertion portions 34*b* of the body section 34*a* are formed from inside toward outside the body section 34*a* by the base slits 92 and the cover slits 102 overlapping each other. Therefore, placing the side plate portions 52 of the divider 50 in the base slits 92 or the cover slits 102 makes it possible to insert the side plate portions 52 into the insertion portions 34*b* in combining the header base 9 and the header cover 10 with each other. This allows a worker to easily attach the divider 50 to the body section 34*a*.

Further, the body section 34*a* is formed such that the surfaces included in the base inner wall surface 9*a* of the pair of base side surface portions 93 and the surfaces included in the cover outer wall surface 10*b* of the pair of cover side surface portions 103 are in contact with each other. This allows a worker to form the body section 34*a* by combining the header base 9 and the header cover 10 with each other and easily manufacture the first header 34 or the second header 35. Further, by having such a configuration, the heat exchanger 30 makes it possible to make the width of the header base 9 or the header cover 10 equal to the width of the first header 34 or the second header 35.

Further, the distance between adjacent ones of the plurality of connecting ports 94 is four times or less as great as the plate thickness of the header base 9. Therefore, the heat exchanger 30 makes it possible to make the distance between adjacent heat-transfer tubes 38 smaller than does a heat exchanger not having such a configuration, increase the number of heat-transfer tubes 38 in the direction of the tube axis of the first header 34, and improve the performance of the heat exchanger 30.

Embodiment 2

Figure 10:
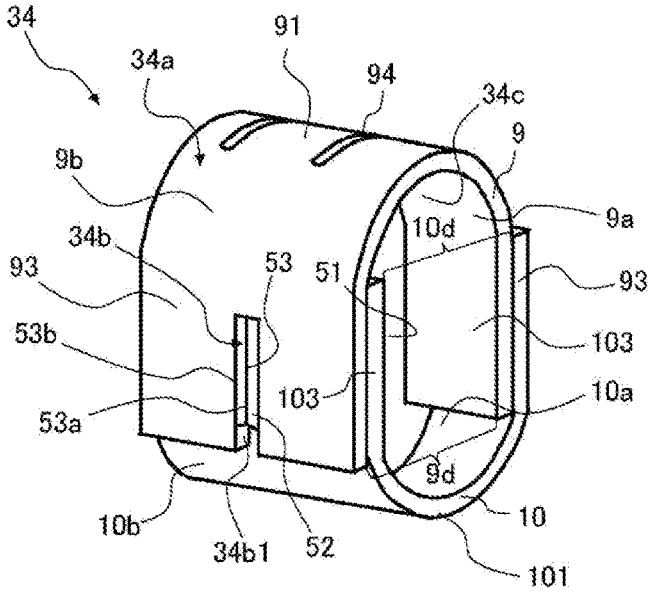
FIG. 10 is an enlarged perspective view of a portion of a first header according to Embodiment 2.
Figure 11:
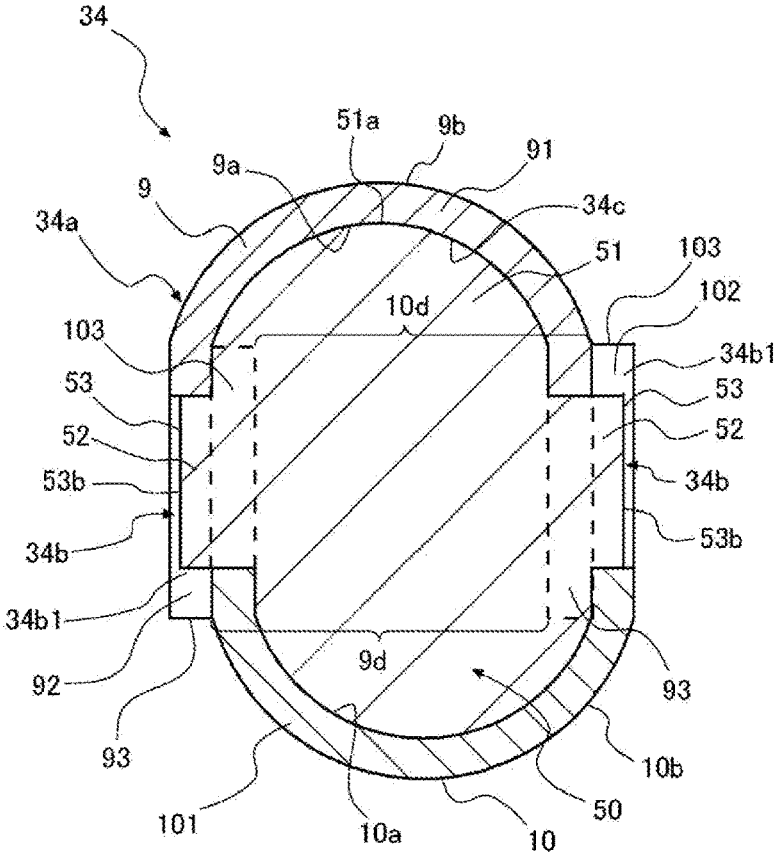
FIG. 11 is a cross-sectional view conceptually showing a cross-section of a portion of the first header according to Embodiment 2 having a divider and a cross-section perpendicular to the direction of the tube axis of the first header.

FIG. 10 is an enlarged perspective view of a portion of a first header 34 according to Embodiment 2. FIG. 11 is a cross-sectional view conceptually showing a cross-section of a portion of the first header 34 according to Embodiment 2 having a divider 50 and a cross-section perpendicular to the direction of the tube axis of the first header 34. It should be noted that FIG. 11 uses dashed lines to indicate elements situated behind the divider 50. Constituent elements having functions and workings that are identical to those of the heat exchanger 30 or other devices according to Embodiment 1 are given identical reference signs, and a description of such constituent elements is omitted. The following description is focused on points of difference of Embodiment 2 from Embodiment 1, and configurations of Embodiment 2 that are similar to those of Embodiment 1 are not described.

The structure of the body section 34*a* of the first header 34 according to Embodiment 2 is different from the structure of the body section 34*a* of the first header 34 according to Embodiment 1. Specifically, the manner in which the header base 9 and the header cover 10 are combined with each other in the body section 34*a* of the first header 34 according to Embodiment 2 is different from the manner in which the header base 9 and the header cover 10 are combined with each other in the body section 34*a* of the first header 34 according to Embodiment 1.

The first header 34 according to Embodiment 2 is formed such that a first one of the pair of base side surface portions 93 is placed in the cover opening 10*d* of the header cover 10. Further, the first header 34 according to Embodiment 2 is formed such that a first one of the pair of cover side surface portions 103 is placed in the base opening 9*d* of the header base 9.

As shown in FIGS. 10 and 11, in a state in which the header base 9 and the header cover 10 are combined with each other, the base side surface portions 93 and the cover side surface portions 103 face and are in contact with each other. In this state, the inside of the first one of the pair of base side surface portions 93 is in contact with the outside of the first one of the cover side surface portions 103, and the outside of a second one of the pair of base side surface portions 93 is in contact with the inside of a second one of the cover side surface portions 103.

In a state in which the header base 9 and the header cover 10 are combined with each other, a surface included in the base inner wall surface 9*a* of the first one of the pair of base side surface portions 93 and a surface included in the cover outer wall surface 10*b* of the first one of the pair of cover side surface portions 103 face and are in contact with each other.

Further, in a state in which the header base 9 and the header cover 10 are combined with each other, a surface included in the base outer wall surface 9*b* of the second one of the pair of base side surface portions 93 and a surface included in the cover inner wall surface 10*a* of the second one of the pair of cover side surface portions 103 face and are in contact with each other.

That is, the body section 34*a* is formed such that a surface included in the base inner wall surface 9*a* of the first one of the pair of base side surface portions 93 and a surface included in the cover outer wall surface 10*b* of the first one of the pair of cover side surface portions 103 are in contact with each other. Further, the body section 34*a* is formed such that a surface included in the base outer wall surface 9*b* of the second one of the pair of base side surface portions 93 and a surface included in the cover inner wall surface 10*a* of the second one of the pair of cover side surface portions 103 are in contact with each other.

In an insertion portion 34*b* formed by the base inner wall surface 9*a* of a base side surface portion 93 and the cover outer wall surface 10*b* of a cover side surface portion 103 making contact with each other, a spread-out plate distal end portion 53 of the divider 50 comes into intimate contact with a base slit 92 of the header base 9 to lock the divider 50 and the header base 9 with each other.

Further, in an insertion portion 34*b* formed by the base outer wall surface 9*b* of a base side surface portions 93 and the cover inner wall surface 10*a* of a cover side surface portions 103 making contact with each other, a spread-out plate distal end portion 53 of the divider 50 comes into intimate contact with a cover slit 102 of the header cover 10. Then, in the first header 34, the plate distal end portions 53 and the cover slits 102 of the header cover 10 come into intimate contact with each other, and the divider 50 and the header cover 10 are thus locked with each other.

<Working Effects of Heat Exchanger 30>

The body section 34*a* is formed such that a surface included in the base inner wall surface 9*a* of the first one of the pair of base side surface portions 93 and a surface included in the cover outer wall surface 10*b* of the first one of the pair of cover side surface portions 103 are in contact with each other. Further, the body section 34*a* is formed such that a surface included in the base outer wall surface 9*b* of the second one of the pair of base side surface portions 93 and a surface included in the cover inner wall surface 10*a* of the second one of the pair of cover side surface portions 103 are in contact with each other.

In the first header 34 according to Embodiment 2, which has such a configuration, the spread-out plate distal end portions 53 of the divider 50 make contact with both the header base 9 and the header cover 10 to lock the header base 9, the header cover 10, and the divider 50 with one another. Therefore, in the first header 34 according to Embodiment 2, the spread-out plate distal end portions 53 of the divider 50 make it possible to temporarily fix three components, namely the header base 9, the header cover 10, and the divider 50, to one another. The temporary fixing of three components, namely the header base 9, the header cover 10, and the divider 50 according to Embodiment 2, to one another can be stronger than the temporary fixing of two components, namely the divider 50 and the header base 9 or the divider 50 and the header cover 10.

The first header 34 according to Embodiment 2 is formed such that in a state in which the header base 9 and the header cover 10 are combined with each other, not similarly to the case of the first header 34 according to Embodiment 1, the header cover 10 is not inserted in the base opening 9*d* of the header base 9. Therefore, the first header 34 according to Embodiment 2 enables commonality between the bend shape of the header base 9 and the bend shape of the header cover 10, making it possible to use the same components as the header base 9 and the header cover 10.

The first header 34 according to Embodiment 2, which makes it possible to use the same components as the header base 9 and the header cover 10, enables commonality of dies for forming the header base 9 and the header cover 10, making it possible to reduce the cost of manufacturing dies. Further, the first header 34 according to Embodiment 2, which makes it possible to use the same components as the header base 9 and the header cover 10, eliminates the need to separately manufacture the header base 9 and the header cover 10, bringing about improvement in productivity of the heat exchanger 30.

Figure 12:
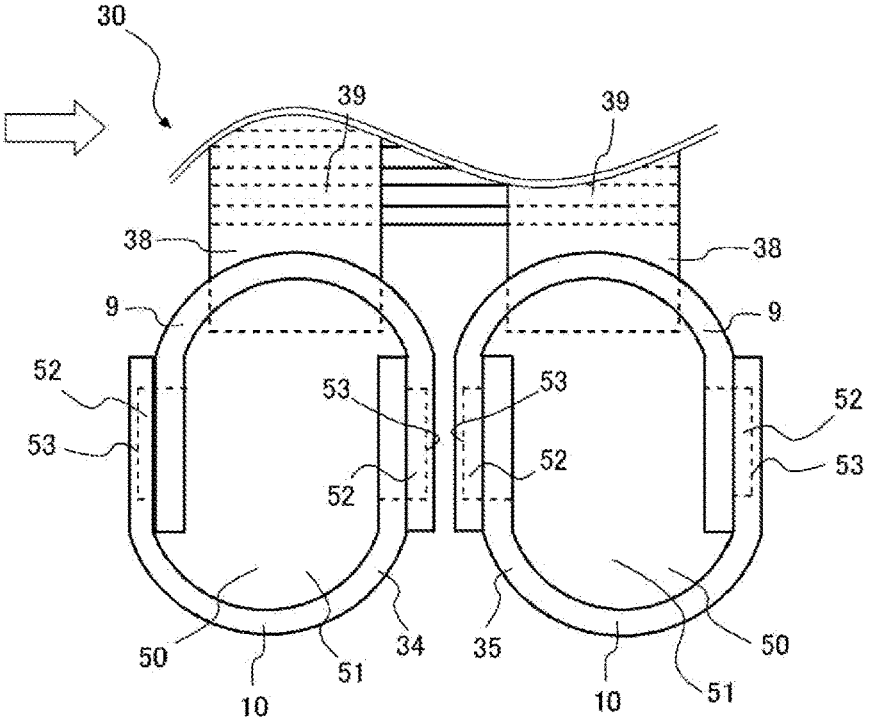
FIG. 12 is a side view conceptually showing a relationship between the divider and a body section of a heat exchanger according to Embodiment 2.

FIG. 12 is a side view conceptually showing a relationship between the divider 50 and the body section 34*a* of the heat exchanger 30 according to Embodiment 2. It should be noted that FIG. 12 shows a heat exchanger 30 in which a divider 50 is used in the second header 35 too. In FIG. 12, the arrow outlined with a blank inside indicates wind currents generated by the fan 13. Since the divider 50 does not protrude from the outer side surfaces of the first header 34 and the second header 35 in a state in which the divider 50 and the body section 34*a* are temporarily fixed to each other, the widths of the first header 34 and the second header 35 can be shortened. Further, as shown in FIG. 12, placing the first header 34 and the second header 35 such that their outsides face each other does not effect a change in installation width of the fins 39 as compared with Embodiment 1 and therefore does not widen the widths of the fins 39.

Embodiment 3

Figure 13:
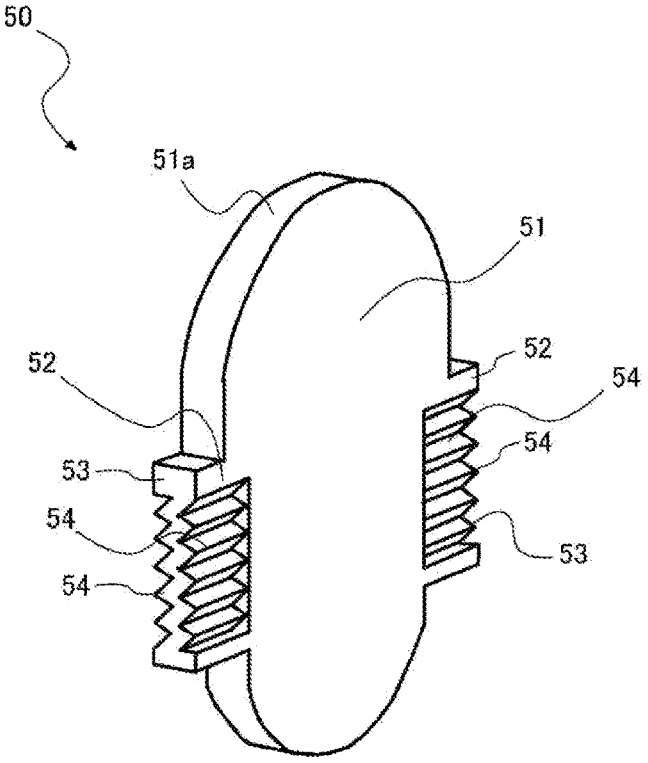
FIG. 13 is an enlarged perspective view of a divider that is used in a first header according to Embodiment 3.

FIG. 13 is an enlarged perspective view of a divider 50 that is used in a first header 34 according to Embodiment 3. It should be noted that constituent elements having functions and workings that are identical to those of the first headers 34 or other elements according to Embodiments 1 and 2 are given identical reference signs, and a description of such constituent elements is omitted. The following description is focused on points of difference of Embodiment 3 from Embodiments 1 and 2, and configurations of Embodiment 3 that are similar to those of Embodiments 1 and 2 are not described.

The first header 34 according to Embodiment 3 is intended to specify the shapes of the side plate portions 52 of the divider 50. The first header 34 according to Embodiment 3 has angular portions 54 formed in the side plate portions 52 of the divider 50.

The pair of side plate portions 52 each have angular portions 54 each formed in a triangular prismatic shape in a wall facing the inner wall 34*b*1 of an insertion portion 34*b* in a direction parallel with the direction of the tube axis of the first header 34. The plurality of angular portions 54 are formed in each of the pair of side plate portions 52, and the plurality of angular portions 54 are formed in parallel in a direction parallel with the direction in which the heat-transfer tubes 38 extend.

More particularly, the angular portion 54 is formed in a triangular prismatic shape. The angular portion 54 is formed in a plate surface of a side plate portion 52 of the divider 50 such that one vertex of the angular portion 54 formed in a triangular prismatic shape protrudes. The angular portion 54 is formed to extend between a plate distal end portion 53 and a basal portion serving as a root portion of the side plate portion 52.

The plate surface of the side plate portion 52 in which the angular portions 54 are formed is a plate surface perpendicular to a direction parallel with the direction of the tube axis of the first header 34. That is, the plate surface of the side plate portion 52 in which the angular portions 54 are formed is a surface facing in the same direction as the wall portion 51 of the divider 50, and is a surface facing in a direction parallel with the direction of the tube axis of the first header 34. The angular portions 54 are formed in each surface of the side plate portion 52 in a direction parallel with the direction of the tube axis of the first header 34.

The angular portions 54 are formed in a location facing the inner wall 34*b*1 of an insertion portion 34*b* of the body section 34*a*. That is, the angular portions 54 are formed in a location facing a base slit 92 of the header base 9. Further, in a case in which the header cover 10 is placed outside the header base 9, the angular portions 54 may be formed in a location facing a cover slit 102 of the header cover 10.

A plurality of the angular portions 54 are formed in a side plate portion 52 of the divider 50. The plurality of angular portions 54 are arranged in a longitudinal direction of the side plate portion 52. The plurality of angular portions 54 are arranged in a direction parallel with the direction in which the heat-transfer tubes 38 extend. The plurality of angular portions 54 may be some or all of the side plate portions 52 in the direction in which the heat-transfer tubes 38 extend. The plurality of angular portions 54 are formed in a sawtooth pattern on a plate surface of the side plate portion 52. The plurality of angular portions 54 are formed in each surface of the side plate portion 52. Therefore, in a plan view of the plate distal end portion 53, the side plate portion 52 is formed in a wavelike shape by the plurality of angular portions 54.

<Working Effects of Heat Exchanger 30>

The first header 34 according to Embodiment 3 has the plurality of angular portions 54 in the side plate portions 52 of the divider 50. The plurality of angular portions 54 are formed in each of the pair of side plate portions 52, and the plurality of angular portions 54 are formed in parallel in a direction parallel with the direction in which the heat-transfer tubes 38 extend, Therefore, when the plate distal end portions 53 of the divider 50 are deformed to be spread out, the angular portions 54 dig as wedges into the header base 9, and the first header 34 thus can strengthen the temporarily fixing of the divider 50 and the header base 9 to each other. It should be noted that although the foregoing description has dealt with a case in which a divider 50 having side plate portions 52 having angular portions 54 is used in the first header 34, a divider 50 having side plate portions 52 having angular portions 54 may be used in the second header 35.

Although the foregoing description deals with an aspect in which the angular portions 54 are formed in the side plate portions 52 of the divider 50, the angular portions 54 are not limited to an aspect in which they are formed in the divider 50. For example, the first header 34 may have angular portions 54 formed in the base slits 92 of the header base 9 instead of having angular portions 54 provided in the divider 50. The angular portions 54 of the base slits 92 are formed in a location facing plate surfaces of the side plate portions 52 in a direction parallel h the direction of the tube axis of the first header 34.

Further, for example, in a case in which the header cover 10 is placed outside the header base 9, the first header 34 may have angular portions 54 formed in the cover slits 102 of the header cover 10 instead of having angular portions 54 provided in the divider 50. The angular portions 54 of the cover slits 102 are formed in a location facing plate surfaces of the side plate portions 52 in a direction parallel with the direction of the tube axis of the first header 34. Also in a case in which the first header 34 has angular portions 54 provided in the base slits 92 of the header base 9 or the cover slits 102 of the header cover 10, the angular portions 54 dig as wedges into the side plate portions 52 of the divider 50 when the plate distal end portions 53 of the divider 50 are deformed to be spread out. Therefore, the first header 34 can strengthen the temporarily fixing of the divider 50 and the header base 9 to each other.

Embodiment 4

Figure 14:
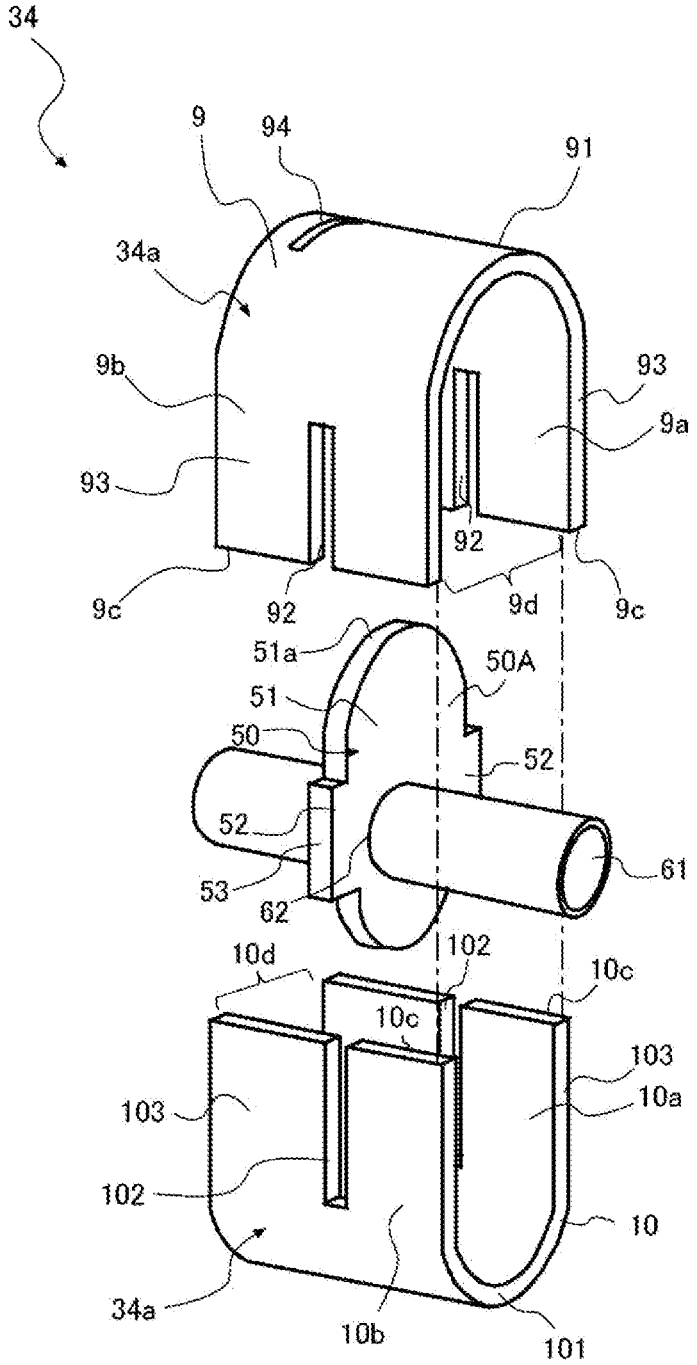
FIG. 14 is an exploded perspective view of a first header according to Embodiment 4.

FIG. 14 is an exploded perspective view of a first header 34 according to Embodiment 4. It should be noted that constituent elements having functions and workings that are identical to those of the first headers 34 or other elements according to Embodiments 1 to 3 are given identical reference signs, and a description of such constituent elements is omitted. The following description is focused on points of difference of Embodiment 4 from Embodiments 1 to 3, and configurations of Embodiment 4 that are similar to those of Embodiments 1 to 3 are not described.

The first header 34 according to Embodiment 4 is one in which the structure of a divider 50 described in Embodiments 1 to 3 is applied to the structure of an end plate 50A. The first header 34 according to Embodiment 4 has a plurality of the dividers 50, and two of the plurality of dividers 50 form two end plates 50A that close both ends of the body section 34*a*. In the first header 34 according to Embodiment 4, the end plates 50A too are formed in the same structure as the structure of the dividers 50, and the side plate portions 52 of the end plates 50A are inserted into the insertion portions 34*b* of the body section 34*a*.

Moreover, the distal end faces of the plate distal end portions 53 of the end plates 50A are spread out by pressing, the side plate portions 52 of the end plates 50A and the insertion portions 34*b* come into intimate contact with each other, and the end plates 50A and the header base 9 are thus locked with each other. Alternatively, the distal end faces of the plate distal end portions 53 of the end plates 50A are spread out by pressing, the side plate portions 52 of the end plates 50A and the insertion portions 34*b* come into intimate contact with each other, and the end plates 50A and the header cover 10 are thus locked with each other.

In an end plate 50A, an inlet openings 62 is provided into which the inlet pipe 61 is inserted. The inlet pipe 61 is inserted in the inlet opening 62 and passes completely through the end plate 50A. That is, a first one of the two end plates 50A is provided with an inlet pipe 61 through which refrigerant flows into the first header 34. The inlet pipe 61 passes completely through the first one of the two end plates 50A.

Alternatively, in an end plate 50A, an outlet opening 64 is provided into which the outlet pipe 63 is inserted (see FIG. 4). The outlet pipe 63 is inserted in the outlet opening 64 and passes completely through the end plate 50A. That is, a second one of the two end plates 50A is provided with an outlet pipe 63 through which refrigerant flows out from inside the first header 34. The outlet pipe 63 passes completely through the second one of the two end plates 50A.

<Working Effects of Heat Exchanger 30>

An end plate 50A has plate distal end portions 53, which are spread out at the insertion portions 34*b*, and the inlet pipe 61 is inserted in the inlet opening 62 and passes completely through the end plate 50A. Therefore, in deforming the plate distal end portion 53, which serves as a side surface of the end plate 50A, a load is applied to the end plate 50A in a direction parallel with a plate surface of the end plate 50A, and the shape of the inlet opening 62 is thus deformed and the inlet pipe 61 thus can be temporarily fixed to the end plate 50A.

Since the inlet pipe 61 can be temporarily fixed to the end plate 50A by pressing against the plate distal end portions 53 of the end plate 50A, the step of temporarily fixing the end plate 50A and the inlet pipe 61 to each other in advance by welding or other processes can be omitted from the process for manufacturing the heat exchanger 30.

Further, an end plate 50A has plate distal end portions 53, which are spread out at the insertion portions 34*b*, and the outlet pipe 63 is inserted in the outlet opening 64 and passes completely through the end plate 50A. Therefore, in deforming the plate distal end portion 53, which serves as a side surface of the end plate 50A, a load is applied to the end plate 50A in a direction parallel with a plate surface of the end plate 50A, and the shape of the outlet opening 64 is thus deformed and the outlet pipe 63 thus can be temporarily fixed to the end plate 50A.

Since the outlet pipe 63 can be temporarily fixed to the end plate 50A by pressing against the plate distal end portions 53 of the end plate 50A, the step of temporarily fixing the end plate 50A and the outlet pipe 63 to each other in advance by welding or other processes can be omitted from the process for manufacturing the heat exchanger 30.

Embodiment 5

Figure 15:
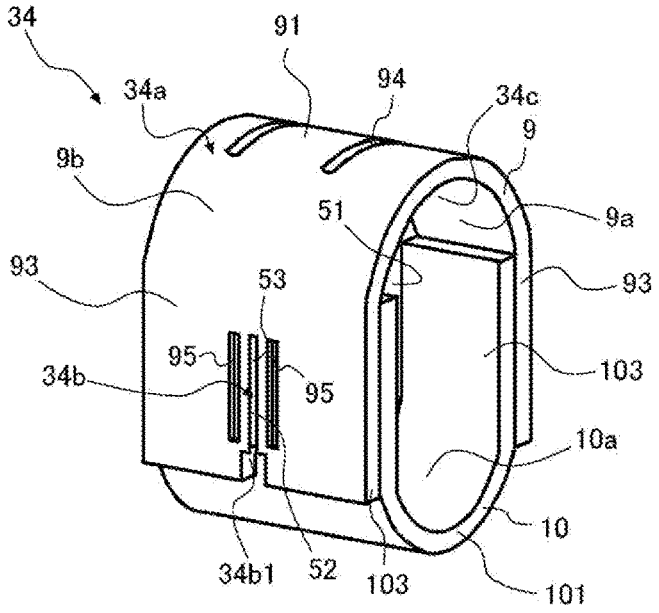
FIG. 15 is an enlarged perspective view showing a portion of a first header according to Embodiment 5.
Figure 16:
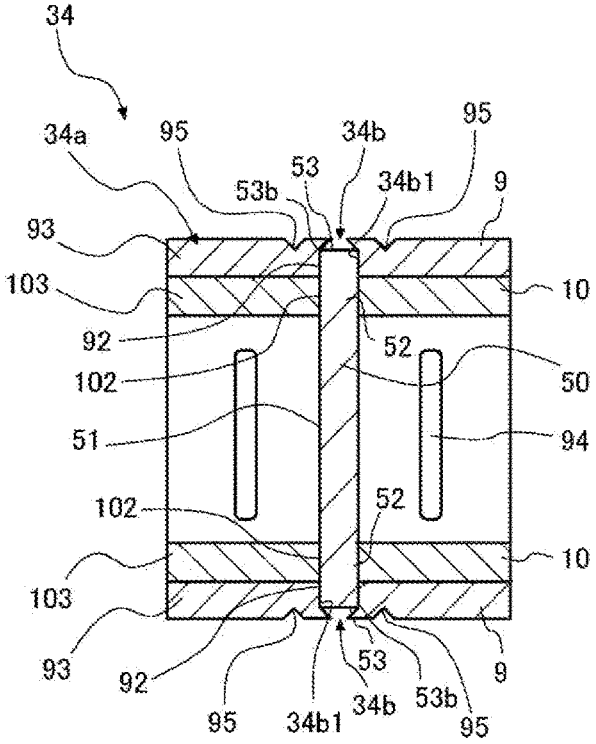
FIG. 16 is a cross-sectional view of the first header according to Embodiment 5 as taken along the direction of the tube axis and a partial cross-sectional view conceptually showing a cross-section of a portion in which a divider is placed.

FIG. 15 is an enlarged perspective view showing a portion of a first header 34 according to Embodiment 5. FIG. 16 is a cross-sectional view of the first header 34 according to Embodiment 5 as taken along the direction of the tube axis and a partial cross-sectional view conceptually showing a cross-section of a portion in which a divider 50 is placed. A detailed configuration of the first header 34 according to Embodiment 5 is described with reference to FIGS. 15 and 16. It should be noted that FIG. 16 shows the locations of connecting ports 94 for the heat-transfer tubes 38.

Constituent elements having functions and workings that are identical to those of the first headers 34 or other elements according to Embodiments 1 to 4 are given identical reference signs, and a description of such constituent elements is omitted. The following description is focused on points of difference of Embodiment 5 from Embodiments 1 to 4, and configurations of Embodiment 5 that are similar to those of Embodiments 1 to 4 are not described.

The first header 34 according to Embodiment 5 has deformed portions 95 in the body section 34*a* in a state in which the body section 34*a* and the divider 50 are temporarily fixed to each other. The deformed portions 95 are formed along the pair of respective insertion portions 34*b*, and are formed by being spread out such that portions of walls of the body section 34*a* each form a groove having a V-shaped cross-section. The deformed portions 95 are provided in both sides of each of the insertion portions 34*b* in a direction parallel with the direction of the tube axis of the first header 34. Since the deformed portions 95 are provided in both sides of each of the insertion portions 34*b* and the side plate portions 52 of the divider 50 are sandwiched between the inner walls 34*b*1 of the insertion portions 34*b* from both sides in a direction parallel with the direction of the tube axis of the first header 34, the side plate portions 52 of the divider 50 more firmly engage with the insertion portions 34*b*. It should be noted that the deformed portion 95 may be provided in only one side of the insertion portion 34*b* in a direction parallel with the direction of the tube axis of the first header 34.

The first header 34 is formed such that in a state in which the body section 34*a* and the divider 50 are combined with each other, the plate distal end portions 53 do not protrude from the pair of respective insertion portions 34*b* toward the outside of the body section 34*a*. Further, the first header 34 is formed such that the size of each of the through holes defined by portions of the inner walls 34*b*1 of the insertion portions 34*b* that face the plate distal end portions 53 is smaller than the size of each of the through holes defined by portions of the inner walls 34*b*1 of the insertion portions 34*b* that face basal portions serving as root portions of the side plate portions 52. The first header 34 is formed such that the inner walls 34*b*1 of the pair of respective insertion portions 34*b* are deformed by the deformed portions 95 toward the centers of the through holes, and the plate distal end portions 53 and the inner walls 34*b*1 of the pair of respective insertion portions 34*b* are in engagement with each other inside the through holes defined by the pair of respective insertion portions 34*b*. That is, the first header 34 is formed such that of the inner walls 34*b*1 of the pair of respective insertion portions 34*b*, inner walls 34*b*1 serving as the insertion portions 34*b* and facing each other are deformed by the presence of the deformed portions 95 in a direction toward each other. Such a deformed state causes the plate distal end portions 53 and the inner walls 34*b*1 of the pair of respective insertion portions 34*b* to be in engagement with each other inside the through holes defined by the pair of respective insertion portions 34*b*.

In a case in which the base side surface portions 93 of the header base 9 are placed outside the cover side surface portions 103 of the header cover 10, the deformed portions 95 are formed in the base side surface portions 93 of the header base 9 in a state in which the body section 34*a* and the divider 50 are temporarily fixed to each other. Alternatively, in a case in which the cover side surface portions 103 of the header cover 10 are placed outside the base side surface portions 93 of the header base 9, the deformed portions 95 are formed in the cover side surface portions 103 of the header cover 10 in a state in which the body section 34*a* and the divider 50 are temporarily fixed to each other.

In a case in which the deformed portions 95 are formed in the base side surface portions 93, the deformed portions 95 are formed along and in the vicinity of the base slits 92. In a case in which the deformed portions 95 are formed in the cover side surface portions 103, the deformed portions 95 are formed along and in the vicinity of the cover slits 102.

The deformed portions 95 are portions formed by deforming portions of the base outer wall surface 9*b* of the base side surface portions 93 or portions of the cover outer wall surface 10*b* of the cover side surface portions 103 by pressing with a tool. The deformed portions 95 are portions of which the base outer wall surface 9*b* of the base side surface portions 93 are spread out by pressing with a tool and depressed toward the base inner wall surface 9*a* of the base side surface portions 93. Alternatively, the deformed portions 95 are portions of which the cover outer wall surface 10*b* of the cover side surface portions 103 are spread out by pressing with a tool and depressed toward the cover inner wall surface 10*a* of the cover side surface portions 103.

In the header base 9, the formation of the deformed portions 95 along the base slits 92 causes the inner walls of the base slits 92 to deform to reduce the opening sizes of the base slits 92. In the header cover 10, the formation of the deformed portions 95 along the cover slits 102 causes the inner walls of the cover slits 102 to deform to reduce the opening sizes of the cover slits 102.

Therefore, in the first header 34, the formation of the deformed portions 95 in the base side surface portions 93 or the cover side surface portions 103 brings the side plate portions 52 of the divider 50 and the base slits 92 into intimate contact with each other to lock the divider 50 and the header base 9 with each other. That is, in the first header 34, the formation of the deformed portions 95 in the base side surface portions 93 or the cover side surface portions 103 brings the outer edges 53*b* of the plate distal end portions 53 into intimate contact with the inner walls 34*b*1 inside the insertion portions 34*b* thus deformed, and the side plate portions 52 are thus fixed to the inner walls 34*b*1 of the insertion portions 34*b*.

The deformed portions 95 are deformed by pressing, for example, with a V-topped die, and the plate surfaces of the base side surface portions 93 or the cover side surface portions 103 are thus split and spread out to right and left, and the inner walls 34*b*1 of the insertion portions 34*b* spread out to right and left thus come into intimate contact with the side plate portions 52 of the divider 50. It should be noted that the term "right and left" here means a direction parallel with the direction of the tube axis of the first header 34.

The deformed portions 95, which are deformed by pressing with a V-topped die, are formed as grooves depressed toward the base inner wall surface 9*a* of the base side surface portions 93. Alternatively, the deformed portions 95, which are deformed by pressing with a V-topped die, are formed as grooves depressed toward the cover inner wall surface 10*a* of the cover side surface portions 103. The deformed portions 95 formed in the shape of grooves are formed to extend in a direction perpendicular to the direction of the tube axis of the first header 34. It should be noted that a direction in which the deformed portions 95 formed in the shape of grooves extend is the same direction as the direction in which the heat-transfer tubes 38 extend in the first header 34.

The deformed portions 95, which are formed along the base slits 92, are formed to have the same lengths as the slit lengths of the base slits 92. The lengths of the deformed portions 95 are not limited to such lengths, but the deformed portion 95 may be formed to have a length smaller than the slit length of the base slit 92, provided the divider 50 and the header base 9 of the body section 34*a* are temporarily fixed to each other.

<Working Effects of Heat Exchanger 30>

The heat exchanger 30 according to the present disclosure is formed such that in a state in which the body section 34*a* and the divider 50 are combined with each other, the plate distal end portions 53 do not protrude from the pair of respective insertion portions 34*b* toward the outside of the body section 34*a*. Further, the first header 34 is formed such that the size of each of the through holes defined by portions of the inner walls 34*b*1 of the insertion portions 34*b* that face the plate distal end portions 53 is smaller than the size of each of the through holes defined by portions of the inner walls 34*b*1 of the insertion portions 34*b* that face basal portions serving as root portions of the side plate portions 52. The first header 34 is formed such that the inner walls 34*b*1 of the pair of respective insertion portions 34*b* are deformed by the deformed portions 95 toward the centers of the through holes, and the plate distal end portions 53 and the inner walls 34*b*1 of the pair of respective insertion portions 34*b* are in engagement with each other inside the through holes defined by the pair of respective insertion portions 34*b*. Therefore, the heat exchanger 30 eliminates the need to fix the body section 34*a* and the divider 50 by causing the divider 50 to protrude from an outer side surface of the first header 34.

By having such a configuration, the heat exchanger 30 makes it possible to, even when the heat exchanger 30 has the divider 50 in the first header 34, make the width of the first header 34 smaller than the width of a header that is required to cause the divider 50 to protrude toward the outside of the body section 34*a* so that the body section 34*a* and the divider 50 are fixed to each other. Further, when such a configuration is applied to the second header 35, the heat exchanger 30 makes it possible to reduce the width of the second header 35 even when the heat exchanger 30 has a divider 50 in the second header 35. Further, when the aforementioned configuration is applied to both the first header 34 and the second header 35, the heat exchanger 30 makes it possible to reduce the width of the heat exchanger 30 and reduce installation space for the heat exchanger 30.

The first header 34 is formed such that the inner walls 34*b*1 of the pair of respective insertion portions 34*b* are deformed by the deformed portions 95 toward the centers of the through holes, and the plate distal end portions 53 and the inner walls 34*b*1 of the pair of respective insertion portions 34*b* are in engagement with each other inside the through holes defined by the pair of respective insertion portions 34*b*. Therefore, the heat exchanger 30 makes it possible to reduce the gaps between the insertion portions 34*b* and the side plate portions 52 and ensure the airtightness of the first header 34 or the second header 35. The heat exchanger 30 makes it possible to, by inserting the side plate portions 52 into the insertion portions 34*b* and then deforming the deformed portions 95 into a state in which the deformed portions 95 are spread out, ensure the airtightness of the first header 34 or the second header 35 without the need to open great gaps between the insertion portions 34*b* and the side plate portions 52 in advance.

The first header 34 according to Embodiment 5 is formed such that the divider 50 and the header base 9 are temporarily fixed to each other by deforming surfaces of the header base 9 in the vicinity of the divider 50 of the first header 34. Alternatively, the first header 34 according to Embodiment 5 is formed such that the divider 50 and the header cover 10 are temporarily fixed to each other by deforming surfaces of the header cover 10 in the vicinity of the divider 50 of the first header 34. The first header 34 according to Embodiment 5, in which the side surfaces of the divider 50 are not deformed, makes it possible to reduce the plate thickness of the divider 50 and reduce the material cost of the heat exchanger 30.

The air-conditioning apparatus 100 described in Embodiment 1 is provided with any one of the heat exchangers 30 of Embodiments 1 to 5. Therefore, the air-conditioning apparatus 100 can bring about effects that are similar to those of the aforementioned heat exchanger 30.

REFERENCE SIGNS LIST

9: header base, 9*a*: base inner wall surface, 9*b*: base outer wall surface, 9*c*: base distal end portion, 9*d*: base opening, 10: header cover, 10*a*: cover inner wall surface, 10*b*: cover outer wall surface, 10*c*: cover distal end portion, 10*d*: cover opening, 11: compressor, 12: flow switching device, 13: fan, 15: outdoor unit, 20: indoor unit, 21: expansion device, 22: indoor heat exchanger, 23: indoor fan, 30: heat exchanger, 31: first heat exchange body, 32: second heat exchange body, 34: first header, 34*a*: body section, 34*b*: insertion portion, 34*b*1: inner wall, 34*c*: inner wall, 35: second header, 38: heat-transfer tube, 39: fin, 40: internal space, 41: distribution space, 42: bridging header, 42*a*: first flow passage, 42*b*: second flow passage, 43: confluence space, 45: confluence and distribution space, 50: divider, 50A: end plate, 51: wall portion, 51*a*: outer edge, 52: side plate portion, 53: plate distal end portion, 53*a*: groove portion, 53*b*: outer edge, 54: angular portion, 61: inlet pipe, 62: inlet opening, 63: outlet pipe, 64: outlet opening, 91: top surface portion, 92: base slit, 93: base side surface portion, 94: connecting port, 95: deformed portion, 100: air-conditioning apparatus, 101: bottom surface portion, 102: cover slit, 103: cover side surface portion

The invention claimed is:

1. A heat exchanger comprising:

a plurality of heat-transfer tubes placed such that the plurality of heat-transfer tubes are spaced from each other; and a header configured to distribute refrigerant to the plurality of heat-transfer tubes, the header having a body section formed in a cylindrical shape and inside which an internal space is defined through which refrigerant flows, and a divider that divides the internal space in the body section in a direction of a tube axis of the header, the body section having a pair of insertion portions that define through holes in both respective side surfaces and that engage with the divider, a header base that has a U-shaped cross-section perpendicular to the direction of the tube axis and to which the plurality of heat-transfer tubes are connected, and a header cover that has a U-shaped cross-section perpendicular to the direction of the tube axis, that is combined with the header base, and that defines the internal space together with the header base, the header base having a pair of base side surface portions forming plate surfaces that face each other, and a top surface portion formed to provide a cross-link between ends of the pair of base side surface portions and connected to the plurality of heat-transfer tubes, the pair of base side surface portions being each formed in a plate shaped and having respective base slits that define holes extending from ends opposite to the top surface portion toward the top surface portion, the header cover having a pair of cover side surface portions forming plate surfaces that face each other, and a bottom surface portion that is formed to provide a cross-link between ends of the pair of cover side surface portions and that faces the top surface portion in the body section, the pair of cover side surface portions being each formed in a plate shaped and having respective cover slits that define holes extending from ends opposite to the bottom surface portion toward the bottom surface portion, the pair of insertion portions being formed from inside toward outside the body section by the base slits and the cover slits overlapping each other, the divider having a wall portion serving as a wall that divides the internal space in the direction of the tube axis, and a pair of side plate portions that protrude from both respective side surfaces of the wall portion and that are inserted into the pair of respective insertion portions, the pair of side plate portions having plate distal end portions that are distal end portions of the pair of respective side plate portions in a direction in which the pair of side plate portions each protrude and that close the through holes in a state in which the pair of side plate portions are inserted in the pair of respective insertion portions, in a state in which the body section and the divider are combined with each other, the plate distal end portions not protruding from the pair of respective insertion portions toward an outside of the body section, the plate distal end portions being deformed in such a state that walls of the plate distal end portions are spread out in a direction parallel with the direction of the tube axis such that end faces of the plate distal end portions each form a V-shaped groove, and being in engagement with inner walls of the pair of respective insertion portions inside the through holes defined by the pair of respective insertion portions.

2. The heat exchanger of claim 1, wherein the header base has a base inner wall surface having surfaces of the pair of base side surface portions that face each other, and a base outer wall surface having surfaces opposite to the surfaces included in the base inner wall surface, the header cover has a cover inner wall surface having surfaces of the pair of cover side surface portions that face each other, and a cover outer wall surface having surfaces opposite to the surfaces included in the cover inner wall surface, and the body section is formed such that the surfaces included in the base inner wall surface of the pair of respective base side surface portions and the surfaces included in the cover outer wall surface of the pair of respective cover side surface portions are in contact with each other.

3. The heat exchanger of claim 1, wherein the header base has a base inner wall surface having surfaces of the pair of base side surface portions that face each other, and a base outer wall surface having surfaces opposite to the surfaces included in the base inner wall surface, the header cover has a cover inner wall surface having surfaces of the pair of cover side surface portions that face each other, and a cover outer wall surface having surfaces opposite to the surfaces included in the cover inner wall surface, and the body section is formed such that a surface included in the base inner wall surface of a first one of the pair of base side surface portions and a surface included in the cover outer wall surface of a first one of the pair of cover side surface portions are in contact with each other and a surface included in the base outer wall surface of a second one of the pair of base side surface portions and a surface included in the cover inner wall surface of a second one of the pair of cover side surface portions are in contact with each other.

4. The heat exchanger of claim 1, wherein, in the body section, a plurality of connecting ports are formed into which the plurality of heat-transfer tubes are inserted, and a distance between adjacent ones of the plurality of connecting ports is four times or less as great as a plate thickness of the header base.

5. The heat exchanger of claim 1, further comprising a plurality of the dividers, wherein two of the plurality of the dividers form two end plates that close both ends of the body section, a first one of the two end plates is provided with an inlet pipe through which refrigerant flows into the header, the inlet pipe passes completely through the first one of the two end plates, a second one of the two end plates is provided with an outlet pipe through which refrigerant flows out from inside the header, and the outlet pipe passes completely through the second one of the two end plates.

6. The heat exchanger of claim 5, further comprising:

two of the headers;

a bridging header provided at ends of the plurality of heat-transfer tubes opposite to ends connected to the two of the headers, the bridging header causing refrigerant to flow between the plurality of heat-transfer tubes connected to a first one of the two of the headers and the plurality of heat-transfer tubes connected to a second one of the two of the headers; and a fin that is a heat-transfer enhancement element and that is placed between adjacent ones of the plurality of heat-transfer tubes.

7. The heat exchanger of claim 6, wherein the header base, the header cover, the divider, the plurality of heat-transfer tubes, the inlet pipe, the outlet pipe, the bridging header, and the fin are made of aluminum.

8. The heat exchanger of claim 1, wherein the pair of side plate portions each have an angular portion formed in a triangular prismatic shape in a wall that face the inner wall of a corresponding one of the pair of insertion portions in a direction parallel with the direction of the tube axis, the angular portion comprises a plurality of angular portions formed in each of the pair of side plate portions, and the plurality of angular portions are formed in parallel in a direction parallel with a direction in which the plurality of heat-transfer tubes extend.

9. A heat exchanger comprising:

a plurality of heat-transfer tubes placed such that the plurality of heat-transfer tubes are spaced from each other; and a header configured to distribute refrigerant to the plurality of heat-transfer tubes, the header having a body section formed in a cylindrical shape and inside which an internal space is defined through which refrigerant flows, and a divider that divides the internal space in the body section in a direction of a tube axis of the header, the body section having a pair of insertion portions that define through holes in both respective side surfaces and that engage with the divider, deformed portions formed along the pair of respective insertion portions and formed by being spread out such that portions of walls of the body section each form a groove having a V-shaped cross-section, a header base that has a U-shaped cross-section perpendicular to the direction of the tube axis and to which the plurality of heat-transfer tubes are connected, and a header cover that has a U-shaped cross-section perpendicular to the direction of the tube axis, that is combined with the header base, and that defines the internal space together with the header base, the header base having a pair of base side surface portions forming plate surfaces that face each other, and a top surface portion formed to provide a cross-link between ends of the pair of base side surface portions and connected to the plurality of heat-transfer tubes, the pair of base side surface portions being each formed in a plate shaped and having respective base slits that define holes extending from ends opposite to the top surface portion toward the top surface portion, the header cover having a pair of cover side surface portions forming plate surfaces that face each other, and a bottom surface portion that is formed to provide a cross-link between ends of the pair of cover side surface portions and that faces the top surface portion in the body section, the pair of cover side surface portions being each formed in a plate shaped and having respective cover slits that define holes extending from ends opposite to the bottom surface portion toward the bottom surface portion, the pair of insertion portions being formed from inside toward outside the body section by the base slits and the cover slits overlapping each other, the divider having a wall portion serving as a wall that divides the internal space in the direction of the tube axis, and a pair of side plate portions that protrude from both respective side surfaces of the wall portion and that are inserted into the pair of respective insertion portions, the pair of side plate portions having plate distal end portions that are distal end portions of the pair of respective side plate portions in a direction in which the pair of side plate portions each protrude and that close the through holes in a state in which the pair of side plate portions are inserted in the pair of respective insertion portions, the header being formed such that in a state in which the body section and the divider are combined with each other, the plate distal end portions do not protrude from the pair of respective insertion portions toward an outside of the body section, that inner walls of the pair of respective insertion portions are deformed by the deformed portions toward centers of the respective through holes such that a size of each of the through holes defined by portions of the inner walls of the pair of insertion portions that face the plate distal end portions is smaller than a size of each of the through holes defined by portions of the inner walls of the insertion portions that face basal portions serving as root portions of the pair of respective side plate portions, and that the plate distal end portions and the inner walls of the pair of respective insertion portions are in engagement with each other inside the through holes defined by the pair of respective insertion portions.

10. A heat exchanger comprising:

a plurality of heat-transfer tubes placed such that the plurality of heat-transfer tubes are spaced from each other; and a header configured to distribute refrigerant to the plurality of heat-transfer tubes, the header having a body section formed in a cylindrical shape and inside which an internal space is defined through which refrigerant flows, and a divider that divides the internal space in the body section in a direction of a tube axis of the header, the body section having a pair of insertion portions that define through holes in both respective side surfaces and that engage with the divider, the divider having a wall portion serving as a wall that divides the internal space in the direction of the tube axis, and a pair of side plate portions that protrude from both respective side surfaces of the wall portion and that are inserted into the pair of respective insertion portions, the pair of side plate portions each having an angular portion formed in a triangular prismatic shape in a wall that face the inner wall of a corresponding one of the pair of insertion portions in a direction parallel with the direction of the tube axis, and plate distal end portions that are distal end portions of the pair of respective side plate portions in a direction in which the pair of side plate portions each protrude and that close the through holes in a state in which the pair of side plate portions are inserted in the pair of respective insertion portions, the angular portion comprising a plurality of angular portions formed in each of the pair of side plate portions, the plurality of angular portions being formed in parallel in a direction parallel with a direction in which the plurality of heat-transfer tubes extend, in a state in which the body section and the divider are combined with each other, the plate distal end portions not protruding from the pair of respective insertion portions toward an outside of the body section, the plate distal end portions being deformed in such a state that walls of the plate distal end portions are spread out in a direction parallel with the direction of the tube axis such that end faces of the plate distal end portions each form a V-shaped groove, and being in engagement with inner walls of the pair of respective insertion portions inside the through holes defined by the pair of respective insertion portions.

* * * * *